US010639526B2

(12) United States Patent
Snyder

(10) Patent No.: US 10,639,526 B2
(45) **Date of Patent: *May 5, 2020**

(54) GOLF CLUB IRONS INCLUDING BACKING MATERIAL BEHIND BALL STRIKING FACE

(71) Applicant: Karsten Manufacturing Corporation, Phoenix, AZ (US)

(72) Inventor: Jeremy N. Snyder, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/372,050

(22) Filed: Apr. 1, 2019

(65) Prior Publication Data

US 2019/0224537 A1 Jul. 25, 2019

Related U.S. Application Data

(63) Continuation of application No. 15/863,671, filed on Jan. 5, 2018, now Pat. No. 10,293,222, which is a continuation of application No. 14/703,562, filed on May 4, 2015, now Pat. No. 9,884,230, which is a continuation of application No. 13/832,153, filed on Mar. 15, 2013, now Pat. No. 9,033,817.

(51) Int. Cl.

| | |
|---|---|
| ***A63B 53/04*** | (2015.01) |
| ***A63B 53/08*** | (2015.01) |
| ***A63B 60/54*** | (2015.01) |

(52) U.S. Cl.

CPC ..... *A63B 53/047* (2013.01); *A63B 53/08* (2013.01); *A63B 60/54* (2015.10); *A63B 2053/0408* (2013.01); *A63B 2053/0416* (2013.01); *A63B 2053/0425* (2013.01); *Y10T 29/49826* (2015.01)

(58) Field of Classification Search

CPC ..... A63B 53/047; A63B 53/08; A63B 60/54; A63B 2053/0416; A63B 2053/0425; A63B 2053/0408

USPC ..... 473/324–350, 287–292

See application file for complete search history.

(56) References Cited

U.S. PATENT DOCUMENTS

| | | | |
|---|---|---|---|
| 708,575 | A | 9/1902 | William |
| 873,423 | A | 12/1907 | James |

(Continued)

FOREIGN PATENT DOCUMENTS

| | | |
|---|---|---|
| GB | 2388792 | 11/2003 |
| KR | 20080047955 | 5/2008 |

OTHER PUBLICATIONS

C-Groove Development, Harold Swash Putting School of Excellence, Aug. 26, 2006, http://www.haroldswashputting_ co.uk/haroldswash_development.htm, 2 pages.

(Continued)

*Primary Examiner* — Sebastiano Passaniti

(57) ABSTRACT

Golf clubs and golf club heads, such as iron heads, may include an iron body and a ball striking plate engaged with the iron body. The ball striking plate may include a face layer and a backing layer. The face layer of the ball striking plate may be formed of a metal material, while the backing layer may be formed of a polymeric material. The backing layer isolates the face layer from the iron body. In some arrangements, the backing layer of the insert may be visible at the top, the bottom, the side and/or the front surfaces of the iron head. Methods for making such iron devices are also described.

18 Claims, 12 Drawing Sheets

(56) References Cited

U.S. PATENT DOCUMENTS

| | | | |
|---|---|---|---|
| 1,289,553 | A | 12/1918 | Archibald |
| 1,562,956 | A | 11/1925 | Guerne |
| 2,005,401 | A | 6/1935 | Storz |
| 2,034,936 | A | 3/1936 | Barnhart |
| 2,429,351 | A | 10/1947 | Fetterolf |
| D210,033 | S | 1/1968 | Johnston |
| 3,975,023 | A | 8/1976 | Inamori |
| 3,979,125 | A | 9/1976 | Lancellotti |
| 4,679,792 | A | 7/1987 | Straza et al. |
| D327,931 | S | 7/1992 | Stuff |
| D327,932 | S | 7/1992 | Stuff |
| 5,299,807 | A | 4/1994 | Hutin |
| 5,354,059 | A | 10/1994 | Stuff |
| 5,358,249 | A | 10/1994 | Mendralla |
| 5,398,929 | A | 3/1995 | Kitaichi |
| 5,403,007 | A | 4/1995 | Chen |
| 5,405,136 | A | 4/1995 | Hardman |
| 5,417,419 | A | 5/1995 | Anderson et al. |
| 5,447,311 | A | 9/1995 | Viollaz et al. |
| 5,492,327 | A | 2/1996 | Biafore, Jr. |
| 5,497,993 | A | 3/1996 | Shan |
| 5,505,450 | A | 4/1996 | Stuff |
| 5,533,728 | A | 7/1996 | Pehoski et al. |
| 5,637,044 | A | 6/1997 | Swash |
| 5,655,976 | A | 8/1997 | Rife |
| 5,766,093 | A | 6/1998 | Rohrer |
| 5,772,527 | A | 6/1998 | Liu |
| 5,807,190 | A | 9/1998 | Krumme et al. |
| 5,944,619 | A | 8/1999 | Cameron |
| 5,971,868 | A | 10/1999 | Kosmatka |
| 5,972,144 | A | 10/1999 | Hsu |
| 5,993,331 | A | 11/1999 | Shieh |
| 6,042,486 | A | 3/2000 | Gallagher |
| 6,093,116 | A | 7/2000 | Hettinger et al. |
| 6,309,310 | B1 | 10/2001 | Shira |
| 6,334,818 | B1 | 1/2002 | Cameron et al. |
| 6,368,234 | B1 | 4/2002 | Galloway |
| 6,431,997 | B1 | 8/2002 | Rohrer |
| 6,443,857 | B1 | 9/2002 | Chuang |
| 6,558,272 | B2 | 5/2003 | Helmstetter et al. |
| 6,699,140 | B1 | 3/2004 | Sun |
| 6,921,343 | B2 | 7/2005 | Solheim |
| 7,070,513 | B2 | 7/2006 | Takeda et al. |
| 7,126,339 | B2 | 10/2006 | Nagai |
| 7,261,644 | B2 | 8/2007 | Burrows |
| 7,294,066 | B1 | 11/2007 | Richard, Jr. |
| 7,367,898 | B2 | 5/2008 | Hawkins et al. |
| 7,387,579 | B2 | 6/2008 | Lin |
| 7,442,129 | B2 | 10/2008 | Bardha |
| D588,222 | S | 3/2009 | Takahashi |
| 7,594,862 | B2 | 9/2009 | Gilbert |
| D605,242 | S | 12/2009 | Franklin et al. |
| 7,717,801 | B2 | 5/2010 | Franklin et al. |
| 7,758,449 | B2 | 7/2010 | Gilbert et al. |
| 7,780,549 | B2 | 8/2010 | Park et al. |
| 7,794,333 | B2 | 9/2010 | Wallans |
| 7,806,779 | B2 | 10/2010 | Franklin et al. |
| 7,819,757 | B2 | 10/2010 | Soracco et al. |
| 7,824,278 | B2 | 11/2010 | Miyamichi |
| 7,841,952 | B1 | 11/2010 | Oldknow et al. |
| 7,846,039 | B2 | 12/2010 | Gilbert et al. |
| 7,862,449 | B2 | 1/2011 | Stites et al. |
| 7,927,230 | B2 | 4/2011 | Solheim |
| 7,942,757 | B2 | 5/2011 | Wallans et al. |
| 7,942,758 | B2 | 5/2011 | Nakamura |
| 8,012,035 | B2 | 9/2011 | Franklin et al. |
| 8,057,322 | B2 | 11/2011 | Wallans |
| 8,062,146 | B2 | 11/2011 | Franklin |
| 8,083,605 | B2 | 12/2011 | Franklin |
| 8,083,611 | B2 | 12/2011 | Kuan |
| 8,092,318 | B2 | 1/2012 | Oldknow et al. |
| 8,210,965 | B2 | 7/2012 | Roach et al. |
| 8,216,081 | B2 | 7/2012 | Snyder |
| 8,287,401 | B2 | 10/2012 | Tateno |
| 8,292,754 | B2 | 10/2012 | Snyder |
| 8,348,782 | B2 | 1/2013 | Park |
| 8,425,342 | B2 | 4/2013 | Snyder |
| 8,550,932 | B2 | 10/2013 | Franklin |
| 8,708,837 | B2 | 4/2014 | Roach |
| 8,858,364 | B2 | 10/2014 | Deng et al. |
| 9,033,817 | B2 | 5/2015 | Snyder |
| 9,884,230 | B2 | 2/2018 | Snyder |
| 10,293,222 | B2 * | 5/2019 | Snyder ..... A63B 53/047 |
| 2002/0019265 | A1 | 2/2002 | Allen |
| 2005/0009631 | A1 | 1/2005 | Krumme |
| 2005/0020378 | A1 | 1/2005 | Krumme et al. |
| 2007/0072698 | A1 | 3/2007 | Juang |
| 2007/0099723 | A1 | 5/2007 | Tateno |
| 2008/0004131 | A1 | 1/2008 | Lin |

OTHER PUBLICATIONS

Rife Two Bar Hybrid Putter Review, Putter Zone Golf, Mar. 7, 2008, http://www.putterzone.com/2008/03/rife-twobar-hybrid-putter-review.html, 3 pages.

* cited by examiner

GOLF CLUB IRONS INCLUDING BACKING MATERIAL BEHIND BALL STRIKING FACE

RELATED APPLICATIONS

This is a continuation of a U.S. patent application Ser. No. 15/863,671 filed Jan. 5, 2018, which is a continuation of U.S. patent application Ser. No. 14/703,562, filed May 4, 2015, now U.S. Pat. No. 9,884,230 issued on Feb. 6, 2018, which is a continuation of U.S. patent application Ser. No. 13/832,153, filed Mar. 15, 2013, now U.S. Pat. No. 9,033,817 issued May 19, 2015, the contents of which are hereby incorporated by reference in its entirety.

FIELD OF THE INVENTION

The invention relates generally to golf club iron heads and irons. Iron heads and irons in accordance with at least some examples of this invention may be constructed to include a backing material behind the ball striking face.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well-known golf superstars, at least in part, have increased golf's popularity in recent years both in the United States and across the world.

Being the sole instruments that set golf balls in motion during play, golf clubs have been the subject of much technological research and advancement in recent years. For example, the market has seen improvements in designs of face plates, the overall golf club head, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golf clubs are designed to transfer the energy of the swung club to the golf ball. It is known that some amount of flex, or elastic deformation, of the club face is desirable to transfer this energy to the golf ball. The coefficient of restitution (COR) is a measure of this transfer. The COR of any typical conventional ball striking face is not constant across the face and is generally designed to be greatest at the desired impact region. Conventional ball striking faces, typically, have a lower COR closer to the perimeter areas where the ball striking face is joined to the rest of the club head body. In particular, certain iron-type golf heads have been designed so that the ball striking face has maximum flex. Such designs may include providing overall thinner ball striking faces, as well as thinning of select areas of the face. For example, in certain designs, the thicknesses of regions where the ball striking face is joined to the club head, such as at the sole or topline, have been reduced. Improving the COR across the ball striking face would provide the golf ball with a greater ball speed, which in turn would allow the ball to go farther. COR is also limited by the Rules of Golf as approved by the United States Golf Association.

However, as golfers tend to be sensitive to the "feel" of a golf club, technological improvements must take this into account. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as a golfer swings and strikes a ball. "Feel" also has been found to be related to the visual appearance of the club and the sound produced when the club head strikes a ball setting the ball in motion.

Accordingly, it may be desirable to improve the transfer of energy of the swung club to the golf ball, while at the same time providing a positive "feel" of the club to a golfer.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to irons and iron heads that include an iron body having a front frame member extending around at least a portion of a perimeter of a front portion of the iron body. The front frame member defines a recess in the front portion of the iron body. A ball striking plate is received in the recess. The ball striking plate includes a face layer and a backing layer engaged with a rear surface of the face layer. The backing layer is exposed at a front surface of the iron head between at least a portion of a perimeter of the face layer and the front frame member of the iron body.

According to certain aspects, the backing layer isolates the face layer from the iron body such that the face layer and the iron body do not directly contact one another. The face layer may be directly affixed only to the backing layer. According to certain embodiments, the perimeter of the face layer is not integrally joined to the iron body.

According to some aspects, the recess may extend to a bottom edge of the iron body, and the backing layer may be exposed along the bottom edge and visible when the bottom edge is viewed. The recess may optionally, extend to a top edge of the iron body and be exposed along the top edge.

According to other aspects, the face layer may be formed of a material having a modulus of elasticity that is greater than the modulus of elasticity of the material forming the backing layer. The face layer may be formed of aluminum, titanium, stainless steel, nickel, beryllium, copper, and/or combinations or alloys including at least one of these metals. A face layer formed of steel alloy may have a maximum thickness ranging from approximately 1.0 mm to approximately 3.0 mm. A face layer formed of a titanium alloy may have a maximum thickness ranging from approximately 1.5 mm to approximately 3.5 mm.

According to even other aspects, the backing layer may be formed of a polymeric material, including a thermoplastic polymeric material, a thermosetting polymeric material, and/or a rubber-type polymeric material. According to some embodiments, the backing layer includes a highly elastic polymeric material. The backing layer may have a varying thickness.

The iron head may be attached to a shaft to form an iron type golf club.

Additional aspects of this invention also relate to methods for making irons and iron heads, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

Figure 1:
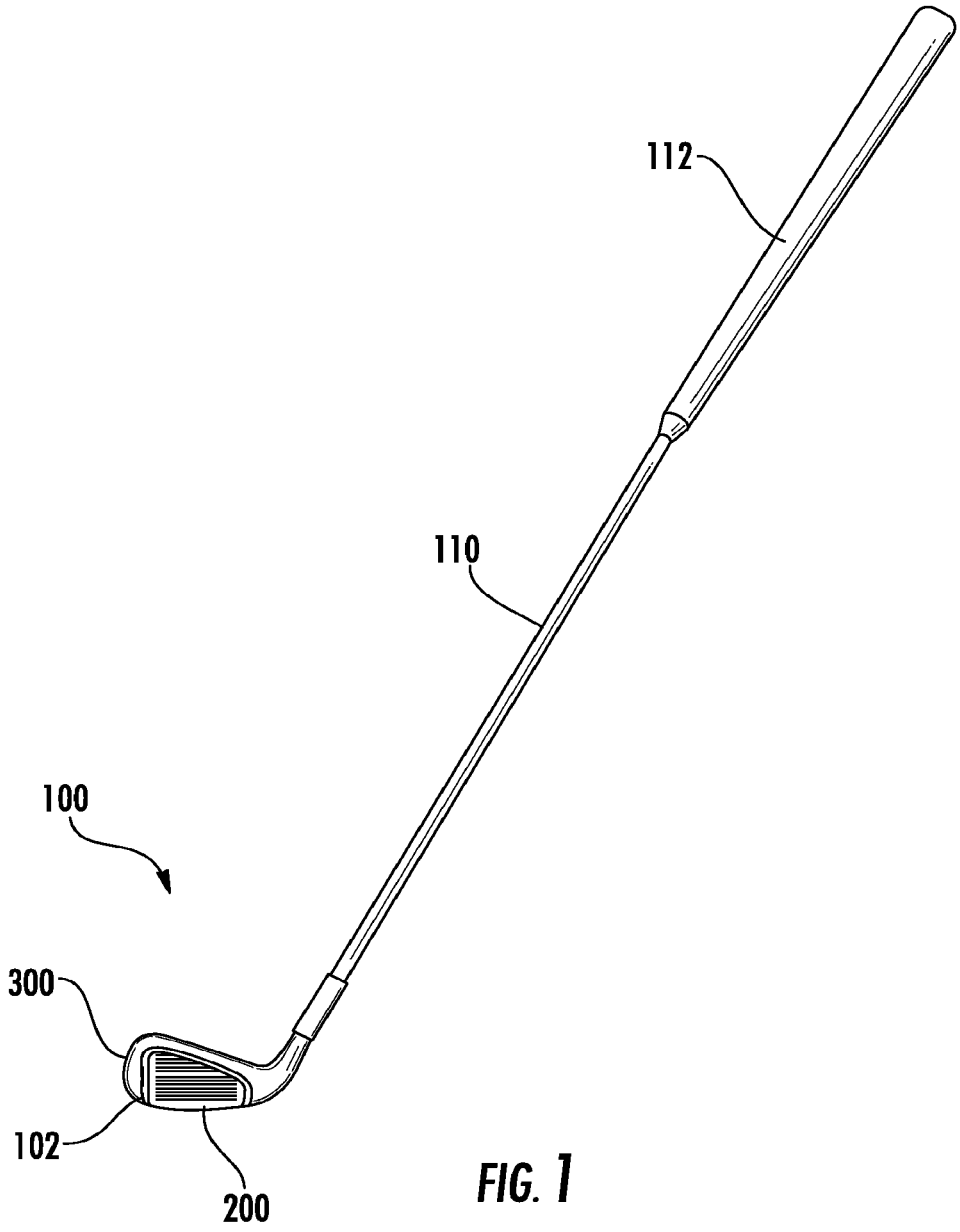
FIG. 1 illustrates an example iron club in accordance with this invention.

The various figures in this application illustrate examples of ball striking devices and portions thereof according to this invention. The figures referred to above are not necessarily drawn to scale, should be understood to provide a representation of particular embodiments of the invention, and are merely conceptual in nature and illustrative of the principles involved. Some features of the ball striking devices depicted in the drawings may have been enlarged or distorted relative to others to facilitate explanation and understanding. When the same reference number appears in more than one drawing, that reference number is used consistently in this specification and the drawings to refer to similar or identical components and features shown in the various alternative embodiments.

DETAILED DESCRIPTION

In the following description of various example iron heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention. It is expected that ball striking devices as disclosed herein would have configurations and components determined, in part, by the intended application and environment in which they are used. Thus, for certain specific embodiments the dimensions and/or other characteristics of the ball striking device structures according to aspects of this invention may vary significantly without departing from the invention.

At least some example aspects of this invention relate to irons and iron heads, as well as to methods of making such structures. A general description of aspects of the invention followed by a more detailed description of specific examples of the invention follows.

The following terms are used in this specification, and unless otherwise noted or clear from the context, these terms have the meanings provided below.

"Integral joining" means a technique for joining two pieces so that the two pieces effectively become a single, integral piece, including, but not limited to, irreversible joining techniques, such as welding, brazing, soldering, or the like, and also including certain adhesive joining. Separation of "integrally joined" pieces cannot be accomplished without structural damage thereto.

"Approximately" incorporates a variation or error of +/−10% of the nominal value stated.

"Stiffness" refers to the rigidity of an object, i.e., the extent to which the object resists deformation in response to an applied force. In other words, the stiffness of a body is a measure of the resistance offered by an elastic body to deformation. The complementary concept is flexibility or pliability; the more flexible an object is, the less stiff it is. Stiffness of an object is related, at least in part, to the modulus of elasticity of the material that forms the object. All other parameters being equal, a material with a high modulus of elasticity may be sought when deflection is to be limited, while a low modulus of elasticity may be advantageous when flexibility is desired. Generally, a material with a relatively high modulus of elasticity has a "lower elasticity" than a material with a lower modulus of elasticity. In other words, a material with "high elasticity," (i.e., a material that stretches relatively easily) would have a relatively low modulus of elasticity.

"Desired-contact" region refers to the as-designed, optimal region of a ball striking plate for contacting the ball or other struck object. This "desired-contact" region is sometimes referred to, informally, as the "sweet spot." For purposes of this disclosure, the desired-contact region is considered to extend through the thickness of the ball striking plate, i.e., the region is not limited to the front surface of the ball striking face. Although in some instances the desired-contact region may generally be centered on the geometric center of the ball striking plate, in other instances, the desired-contact region may be located off-center. Further, a first desired-contact region may be defined as the area of the ball striking plate that is capable of achieving at least 99.7% of the maximum ball speed achievable by the ball striking device. Alternatively, a less stringent, second desired-contact region may be defined as the area of the ball striking plate that is capable of achieving at least 99.5% of the maximum ball speed achievable by the ball striking device. Event further, a more relaxed, third desired-contact region may be defined as the area of the ball striking plate that is capable of achieving at least 99.0% of the maximum ball speed achievable by the ball striking device.

The term "thickness" or "plate thickness," when used in reference to a ball striking plate (or alternatively, when referring to a face layer or a backing layer of the ball striking plate) as described herein refers to the distance between the front surface of the ball striking plate and the rear surface of the ball striking plate. The thickness is generally the distance between a point on the front surface of the ball striking plate and the nearest point on the rear surface of the plate, respectively, and may be measured perpendicularly to the front or rear surface at the point in question. "Generally constant thickness" incorporates a variation or error of +/−5% of the average thickness over the entirety of the area in question.

A. GENERAL DESCRIPTION OF IRONS, IRON HEADS, AND METHODS ACCORDING TO ASPECTS OF THE INVENTION

In general, aspects of this invention relate to irons and iron heads. Such golf club heads, according to at least some example embodiments of the invention, includes: (a) an iron body (made from one or multiple independent pieces or parts); and (b) a ball striking plate having a face layer of a first material and a backing layer of a second material. The backing layer engages a rear surface of the face layer and a front face of the iron body and is sandwiched between the iron body and the face layer.

According to certain aspects, the perimeter of the face layer is not directly attached to the iron body. According to other aspects, the material of the face layer has a first modulus of elasticity. The material of the backing layer has a second modulus of elasticity that is lower than the first modulus of elasticity. Thus, flexing of the face layer may be reacted by compression of the backing layer.

A noted above, golf clubs are designed to transfer the energy of the swung club to the golf ball. By controlling the amount of flex, or elastic deformation, of the club face the coefficient of restitution (COR) across the face may be optimized. One way to control the amount of flex of the ball striking face is to control the means of mounting the ball striking face to the club head. If the perimeter of the ball striking face is fixedly attached to the remainder of the club, the ball striking face will be restrained from freely flexing. This is because the edge of the ball striking face is at least partially restrained from moving (both in-plane and out-of-plane) and from rotating (for example, out-of-plane rotation).

According to certain aspects of the invention, the face layer of the ball striking plate disclosed herein may be essentially freed from these edge restraints. The ball striking plate may be provided with a face layer "floating" on a backing layer. In other words, the face layer may be coupled to the remainder of the club head via the backing layer, and only via the backing layer. The face layer may, thus, be essentially decoupled from the perimeter frame of the remainder of the club head. This decoupling allows the perimeter of the face layer to freely move in-plane and out-of-plane and to rotate out-of-plane. Thus, by reducing or eliminating the edge constraints, the flexibility of the face layer may be greatly enhanced.

According to some aspects, the face layer may have a relatively high modulus of elasticity. In contrast, the backing layer may be formed of a material with a relatively low modulus of elasticity. The backing layer may support the face layer yet allow the face layer to easily flex. Further, according to certain embodiments, the backing layer may compress or elastically deform with the flexing of the face layer and may also provide spring back energy for the club head to transfer to the golf ball. Providing a face layer that floats on a highly elastic backing layer may also improve the COR of the ball striking plate over its entire surface, especially at the perimeter edges of the ball striking face layer.

Thus according to some aspects, the material of the face layer may have a first modulus of elasticity that is relatively high. For example, the material of the face layer may be a metal or a polymer. Suitable metal materials include aluminum, titanium, steel (including stainless steel), nickel, beryllium, copper, combinations and/or alloys thereof, etc. As other examples, the face layer may be formed of a material having a very high modulus of elasticity, including a metallic glass, a ceramic, etc.

The face layer may have a substantially planar front surface and/or a substantially planar rear surface. According to certain embodiments, the face layer may have a front surface contoured to provide specific loft, bulge or roll characteristics. Further, the face layer may be provided with grooves, as known in the art, and/or with microgrooves formed in the front surface. According to some aspects, the face layer contains no through-openings or other passageways that extend completely through the face layer.

According to certain embodiments, the face layer may have a generally constant thickness. Such a generally constant thickness may range from approximately 1.0 mm to approximately 5.0 mm, from approximately 1.5 mm to approximately 4.0 mm, or even from approximately 1.5 mm to approximately 3.0 mm. Even further, the face layer may have a rear surface contoured or locally thickened to reinforce areas subjected to high stress during the impact event. Such thickening may be especially advantageous in the desired-contact region. Thus, according to some embodiments, the face layer may have a varying thickness. The minimum thickness may be greater than approximately 0.5 mm. Further, the minimum thickness may be less than approximately 2.0 mm. The maximum thickness may be greater than approximately 3.0 mm. The maximum thickness may be less than approximately 5.0 mm. As one example, the thickness of the face layer may be a minimum at the perimeter edge of the face layer. Any such variation in thickness may be gradual (i.e., sloped) or stepped.

The face layer may be formed of a single material or of multiple materials. If formed of multiple materials, the face layer may be formed as a laminate of multiple thin sub-layers. In certain embodiments, the material forming the front-most laminate sub-layer of the face layer, i.e., the material that contacts the golf ball, may be a metal. Optionally, if formed of multiple materials, a first face layer material may be provided in the desired-contact region and a second face layer material may be provided around the desired-contact region and/or at the perimeter of the face layer. In particular, the material provided in the desired-impact region may be a metal. If formed of multiple materials, the modulus of elasticity of the material forming the face layer may be determined based on the entire laminate.

Additional aspects of this invention relate to the material of the backing layer. The material of the backing layer may be a polymeric material, including thermosets, thermoplastics, rubbers, elastomers, etc. and the like.

In certain embodiments, the material of the backing layer may be a highly-elastic polymer such as a natural rubber, synthetic rubber and rubber blend. Elasticity is a measure of the material's ability to return to its original shape after a stress that caused deformation is no longer applied. For very small deformations, most elastic materials exhibit linear elasticity. A highly-elastic material may be subjected to greater deformations and may exhibit non-linear elasticity, yet still return to its original shape.

In some embodiments, the material of the backing layer may have a relatively high rebound elasticity. Rebound elasticity expresses the capacity of the material to return mechanical energy to the system as opposed to dissipating mechanical energy. Specifically, it may be measured by means of an instrument called a Rebound Pendulum, which measures how much mechanical energy is put back into a steel ball falling from a specific height on to a test piece of the material under examination. A rebound elasticity of greater than 20% may be advantageous, while a rebound elasticity of greater than 30% or even 40% may be particularly desirable.

In some embodiments, the material of the backing layer may have a relatively low hysteresis damping factor. The greater the hysteresis damping factor, the greater is the material's capacity for dissipating mechanical energy. Thus, a backing layer formed of a low hysteresis damping material will tend to not dissipate the mechanical energy introduced on impact with the ball. Energy may be transmitted through such a low hysteresis backing layer to the body of the club head and then reflected back to the face layer.

In contrast, according to certain aspects, the material used for the backing layer may include a material having viscoelastic properties or characteristics. A viscoelastic material has a strain rate dependent on time. Thus, the effective stiffness of a viscoelastic material depends on the rate of application of the load. Further, when subjected to a stress, viscoelastic materials may exhibit some lag in strain. Even further, a viscoelastic material typically loses energy when a load is applied and then removed. The energy lost during such a loading cycle is due to hysteresis in the stress-strain curve, with the area of the hysteresis loop being equal to the energy lost during the loading cycle. Thus, viscoelastic materials tend to dissipate mechanical energy and dampen or attenuate acoustic waves. Attenuating certain acoustic waves may be desirable, for example, when high frequency acoustic waves result in an undesirable ringing sound.

In general, any suitable polymeric material may be used for the backing layer without departing from this invention, including thermoplastic or thermosetting polymeric materials, synthetic or natural rubber type polymeric materials, etc. Example thermosets may include polyurethanes, vinyls (e.g., ethylvinylacetates, etc.), nylons, polyethers, polybutylene terephthalates, etc. Example thermoplastics may include polyamides, polyesters and polyurethanes.

Further, the polymeric material forming the backing layer may be co-molded, overmolded, injection molded, compression molded, cast, machined, etc. It is expected that the polymeric material forming the backing layer will typically be solid (i.e., unfoamed) although for certain applications, it may be foamed (open or closed cell). The backing layer may have a generally constant thickness. For example, the backing layer may have a generally constant thickness if it were to be supplied as a partially-cured blank or pre-form. Such a generally constant thickness of the backing layer may range from approximately 0.25 mm to approximately 4.0 mm, from approximately 0.5 mm to approximately 3.0 mm, or even from approximately 1.0 mm to approximately 2.5 mm. According to some embodiments, the backing layer may have a varying thickness. A minimum thickness may range from approximately 0.25 mm to approximately 1.0 mm. A maximum thickness of the backing layer may range from approximately 2.5 mm to approximately 4.5 mm. As one example, the thickness of the backing layer may be a minimum in a central region of the ball striking plate. Any such variation in thickness may be gradual (i.e., sloped) or stepped. Optionally, according to certain aspects, the backing layer may extend up and around the perimeter edges of the face layer. The height of the backing layer extending up and round such perimeter edges would not be considered when determining a maximum thickness of the backing layer. In other words, the thickness of the backing layer is measured from the rear surface of the face layer to the forward surface of the iron body—the thickness of the backing layer is that portion sandwiched between the rear surface of the face layer and the iron body. According to some aspects, the backing layer may flow during assembly of the backing layer to the face layer and/or to the iron body such that the backing layer takes on the shape of the object to which it is joined. As such, the backing layer may have a varying thickness governed by the contours of one or both of the opposed surfaces of the face layer and the iron body.

The backing layer may be formed from a single material or it may be formed of multiple materials. According to some aspects, the backing layer may be formed as a laminate of a plurality of thin laminae. As a laminate, the individual laminae engage one another such that shear loads may be transmitted between the layers. The individual laminae may be formed of any of the above-noted polymeric materials. Thus, for example, the backing layer may include a laminae of a highly elastic material coupled to a very thin layer of a viscoelastic material. It is expected that such a laminated backing layer may be tailored to provide a degree of spring back, while at the same time attenuating high frequency acoustic waves. Even further, one or more of the individual laminae may be formed of a material other than a polymeric material, e.g., a thin layer of metal, glass, fibers, etc.

The ball striking plate includes the face layer engaged to the backing layer. It is understood that the face layer and the backing layer of the ball striking plate may be selected in a specific cooperative combination of materials that will provide desired performance characteristics of the golf club head. It is further understood that the face layer and the backing layer of the ball striking plate may be selected in a specific cooperative combination of thicknesses, shapes, extent of overlap, etc. that will provide desired performance characteristics of the golf club head.

Thus, according to some embodiments, the backing layer of the ball striking plate may extend over the entire rear surface of the face layer, such that the backing layer overlaps 100% of rear surface area of the face layer. Optionally, the backing layer may extend over select portions of the rear surface of the face layer. For example, the backing layer may extend over more than 70%, more than 80%, or even more than 90% of the area of the rear surface of the face layer. In other embodiments, the maximum amount of overlap may be limited. Thus, the backing layer may extend over less than 90%, less than 80%, or even less than 70% of the area of the rear surface of the face layer. Further, the backing layer may be discontinuous. For example, the backing layer may be provided as an expanding series of "rings" separated by unsupported regions (much like a bull's eye type target.). The rings need not be circular, continuous, evenly spaced, or of even width. In one embodiment, the "rings" may substantially follow the perimeter shape of the face layer. As another example, the backing layer may be provided as a plurality of rays radiating from the desired-contact region. Thus, persons of ordinary skill in the art, given the benefit of this disclosure, would understand that a wide variety of configurations of the backing layer may be provided to develop suitable or desired performance characteristics of the golf club head.

The ball striking plate may be provided with any shape. As one example, the ball striking plate may have a perimeter shape that follows the shape of the iron head. Indeed, the ball striking plate may have a perimeter that complementarily matches (both as to shape and size) the perimeter of the iron head. Optionally, the ball striking plate may have a perimeter shape that follows the shape of the iron head along at least one edge (sole, toe, top, heel), but that lies inboard of the perimeter of the iron-head along this at least one edge. According to even other aspects, the ball striking plate need not follow the perimeter shape of the iron head, but may assume any shape. For example, to maximize the COR and/or to optimize the COR distribution, it may be desirable to provide a ball striking plate having only rounded, gradually curved, relatively cornerless shapes, such as circular, elliptical, oval, kidney-shaped, peanut-shaped, or other regular or irregular smoothly-curved shapes.

According to some aspects, the iron body may include a recess formed in the front face or front portion of the iron body. The recess may be surrounded or at least partially bounded by a front frame member of the iron body. The front frame member may be continuous or it may be made of separated perimeter front frame segments without departing from the invention. Also, the front frame member may have a constant or varying size over its overall perimeter length (e.g., a constant or varying front-to-rear height, a constant or varying top-to-bottom thickness, and/or a constant or varying heel-to-toe width, etc.). Further, the cross-section contour or profile (more or less rounded, flat, squared, peaked, symmetric, asymmetric, etc.) of the front frame member may vary as it extends along the perimeter of the iron body.

For certain embodiments, the recess may be bounded on three sides by the front frame member. For example, the recess may be enclosed by the front frame member on the toe side, on the top, and on the heel side, but not enclosed on the bottom. According to other embodiments, the recess may be bounded on only two sides or even on only one side. For example, the front frame member may be provided as a relatively thin lip that extends along the bottom edge of the iron head. According to even other embodiments, the front frame member may extend discontinuously and/or only partially along any given edge of the iron head. Thus, as another example, the front frame member may extend around the "corners" of the front face of the iron body (i.e., where the top edge meets the toe side or the heel side and/or where the bottom edge meets the toe side or the heel side), but not from corner to corner.

The ball striking plate may be formed in any appropriate shape for inclusion in the iron body and may comprise more than 80%, more than 90%, or even more than 95% of the entire front portion of the iron body. The ball striking plate may have a constant or varying thickness, and the overall thickness (i.e., the thickness of the face layer and of the backing layer) may range, for example, from 1.0 mm to 7.0 mm thick, and in some examples, from 2.0 mm to 5.0 mm thick.

The ball striking plate may be located within this recess such that the backing layer is sandwiched between the face layer and the iron body. According to certain embodiments, the backing layer may further extend around some or all the perimeter edges of the face layer such that when the ball striking plate is located within the recess, the backing layer may further lie between the perimeter of the face layer and the bounding surface of the front frame member. In such case, some or all of the perimeter edges of the face layer may be "framed" by the backing layer and this backing layer frame may be visible on the front surface or front portion of the club head. Further, the backing layer that frames the face layer and that is exposed on the front portion of the club head may be flush with the front surface of the front face of the iron body. As noted above, the front frame member of the iron body need not extend completely around the perimeter of the ball striking plate (e.g., the recess is a three-sided recess, a two-sided recess, the frame member extends alone one edge of the perimeter of the iron body, the frame member is discontinuous, etc.). In such case, a portion of the perimeter of the backing layer may be visible from an edge of the club head where the recess is unframed.

According to certain embodiments, the face layer may be formed without any through-openings, e.g., apertures, holes, slots or cutouts that extend completely through the face layer from a face surface to a rear surface. Because the face layer is void of through-openings, the backing layer, which may be exposed at the front surface of the club head at the perimeter of the face layer, would not be exposed at the front surface within the perimeter of the face layer. According to other embodiments, the face layer may be formed without any through-openings in the desired-contact region. Because the desired-contact region of the face layer is void of through-openings, the backing layer, which may be exposed at the front surface of the club head at the perimeter of the face layer, would not be exposed at the front surface within the desired-contact region. Thus, according to certain embodiments, within the desired-contact region only the material of the face layer is present and no material of the backing layer is exposed or visible. As another example, the backing layer may be limited to being exposed at the front surface of the club head to regions that are remote from the desired-contact region and/or from a central region.

According to other aspects, the front portion of the iron body may be "frameless," i.e., the iron body may be formed without a frame member extending around the perimeter of the front portion. As one example, the front portion of the iron body may be substantially planar (i.e., without a recess) and the ball striking plate may be affixed to this substantially planar front face. The backing layer of the ball striking plate may extend over the entire rear surface of the face layer and may be sandwiched between the face layer and the substantially planar front portion of the iron body. Thus, according to some embodiments, the ball striking plate with its face layer and coextensive backing layer may extend over the entire front portion, or substantially the entire front portion, of the iron body. In such case, the entire perimeter of the backing layer may be visible along the perimeter edges of the club head.

According to other embodiments, the front portion of the iron body may be substantially planar, the ball striking plate may be affixed to this substantially planar front face, and the backing layer may extend over only a portion of the rear surface area of the face layer. For example, the backing layer may extend around the perimeter region of the rear surface of the face layer, but be absent from specific regions of the rear surface within the perimeter region. As another example, the backing layer may be provided as a separately formed preform having holes, perforations, cutouts, and the like, formed therein. As even another option, the backing layer may extend over substantially the entire rear surface of the face layer (i.e., be substantially coextensive with the face layer), yet be affixed to less than the entire rear surface area of the face layer.

Additional aspects of this invention relate to methods for making iron devices (such as irons and iron heads of the types described above). Such methods may include, for example: (a) providing an iron body (e.g., by manufacturing it, by obtaining it from a third party source, etc.); (b) providing a face layer (e.g., by manufacturing it, by obtaining it from a third party source, etc.); (c) providing a backing layer (e.g., by manufacturing it, by obtaining it from a third party source, etc.); (d) joining the backing layer to the face layer to thereby form a ball striking plate; and (e) joining the backing layer to the iron body.

In one example structure according to this invention, the iron body may be made primarily from 1020 forged carbon steel. The iron body may be made from one or multiple independent parts and these pieces may be integrally joined together. When made from multiple parts, some parts of the iron body may be added to the overall iron head or after the ball striking plate is fitted to the iron body, without departing from this invention.

For certain embodiments, joining the backing layer to the face layer to form a ball striking plate may precede joining the backing layer to the iron body. For example, the face layer may be placed into mold and the backing layer may be overmolded or co-molded to it. In a subsequent step, the backing layer of the now-formed ball striking plate may be joined to the iron body. As another example, the face layer and the backing layer may be adhesively bonded to one another prior to joining the backing layer to the iron body.

For other embodiments, joining the backing layer to the face layer to form a ball striking plate may follow the step of joining the backing layer to the iron body. For example, the iron body may be placed into mold and the backing layer may be overmolded or co-molded to it. In a subsequent step, the face layer may be joined to the backing layer. As another example, the iron body and the backing layer may be adhesively bonded to one another prior to joining the facing layer to the backing layer. The thickness of the backing layer may range from approximately 0.5 mm to approximately 3.0 mm.

The thickness of the adhesive layer will typically be less than 200 μm and for less viscous adhesive may be less than 150 μm and even may be less than 100 μm. Further, the material of the adhesive layer will be optimized for bonding and will be different from the material of the backing layer.

In even certain other embodiments, the backing layer may be joined to the iron body and to the face layer in a single processing step. For example, should a recess be defined in the iron body, the recess may function as a mold during assembly. Thus, a precursor to the polymeric material forming the backing layer or a partially cured blank may be placed within the recess and the face layer may be positioned above the material. The polymeric material forming the backing layer may be cured and simultaneously the backing layer may be affixed or joined to the iron body and to the face layer to thereby simultaneously form the ball striking plate and the iron head.

Thus, the backing layer may be joined with the face layer and/or to the iron in a variety of ways as would be apparent to persons of ordinary skill in the art given the benefit of this disclosure without departing from this invention, e.g., by co-molding, overmolding (including insert molding, multi-shot molding, in-mold assembly, multi-component molding, etc.), by adhesive bonding, etc.

Further finishing steps, such as grinding, polishing, chroming, anodizing, etching, painting, sealing, etc., may be performed on the iron head. Additional steps to form an iron club may include attaching a shaft member to the iron body and attaching a grip member to the shaft member. The finished iron club may have any of the various characteristics described above.

Other aspects of the invention relate to iron heads wherein the backing layer may, in some instances, form or include a gasket to aid in sealing the connection between the ball striking plate and the iron body. Such a gasket may prevent moisture, debris, etc. from entering between the face layer and the iron body.

In some examples, the ball striking plate may be releasably or removably engaged with the iron body such that the ball striking plate may be removed without damaging the ball striking plate or the iron body. A second, interchangeable ball striking plate may then be located within the recess or on the front face of the iron body. This second ball striking plate may have performance characteristics different from the performance characteristics of the first insert. For instance, different materials and/or different dimensions of the face layer and/or the backing layer may be used to provide different stiffnesses, sound, and/or other "feel" characteristics to each ball striking plate.

Specific examples of the invention are described in more detail below. The reader should understand that these specific examples are set forth merely to illustrate examples of the invention, and they should not be construed as limiting the invention. Further, U.S. patent application Ser. No. 12/755,330, filed Apr. 6, 2010, to Snyder et al. and titled "Putter Heads and Putters Including Polymeric Material as Part of the Ball Striking Face" is incorporated by reference in its entirety herein.

B. SPECIFIC EXAMPLES OF THE INVENTION

The various figures in this application illustrate examples of irons, components thereof, and methods in accordance with examples of this invention. FIG. 1 illustrates an example iron-type golf club structure 100 in accordance with this invention. The iron club 100 includes an iron head 102 having a ball striking plate 200 attached to an iron body 300. A shaft member 110 is engaged with the iron head 102. A grip 112 may be engaged with the shaft member 110. The shaft member 110 and the grip 112 may be formed and engaged in any suitable manner as would be known by persons of ordinary skill in the art.

Figure 2A:
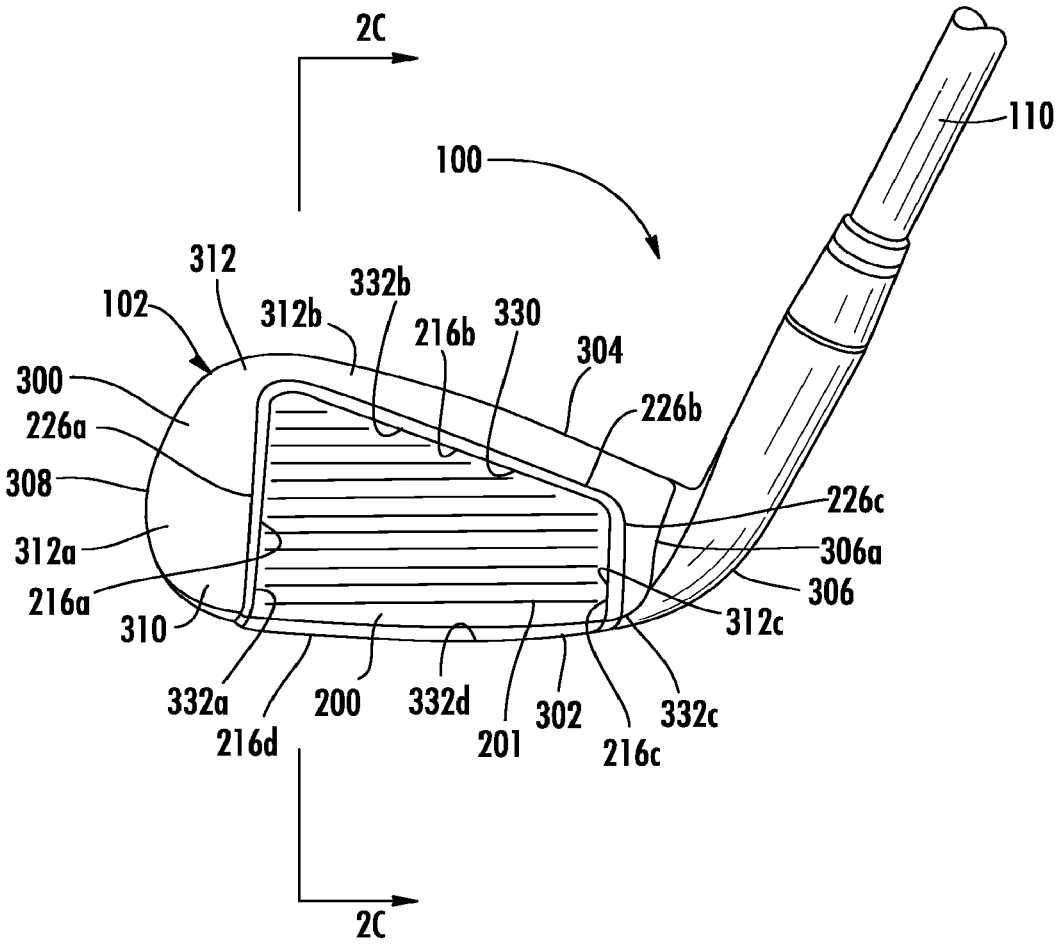
FIGS. 2A through 2D illustrate details and additional features of the iron club of FIG. 1 in accordance with examples of this invention.
Figure 2B:
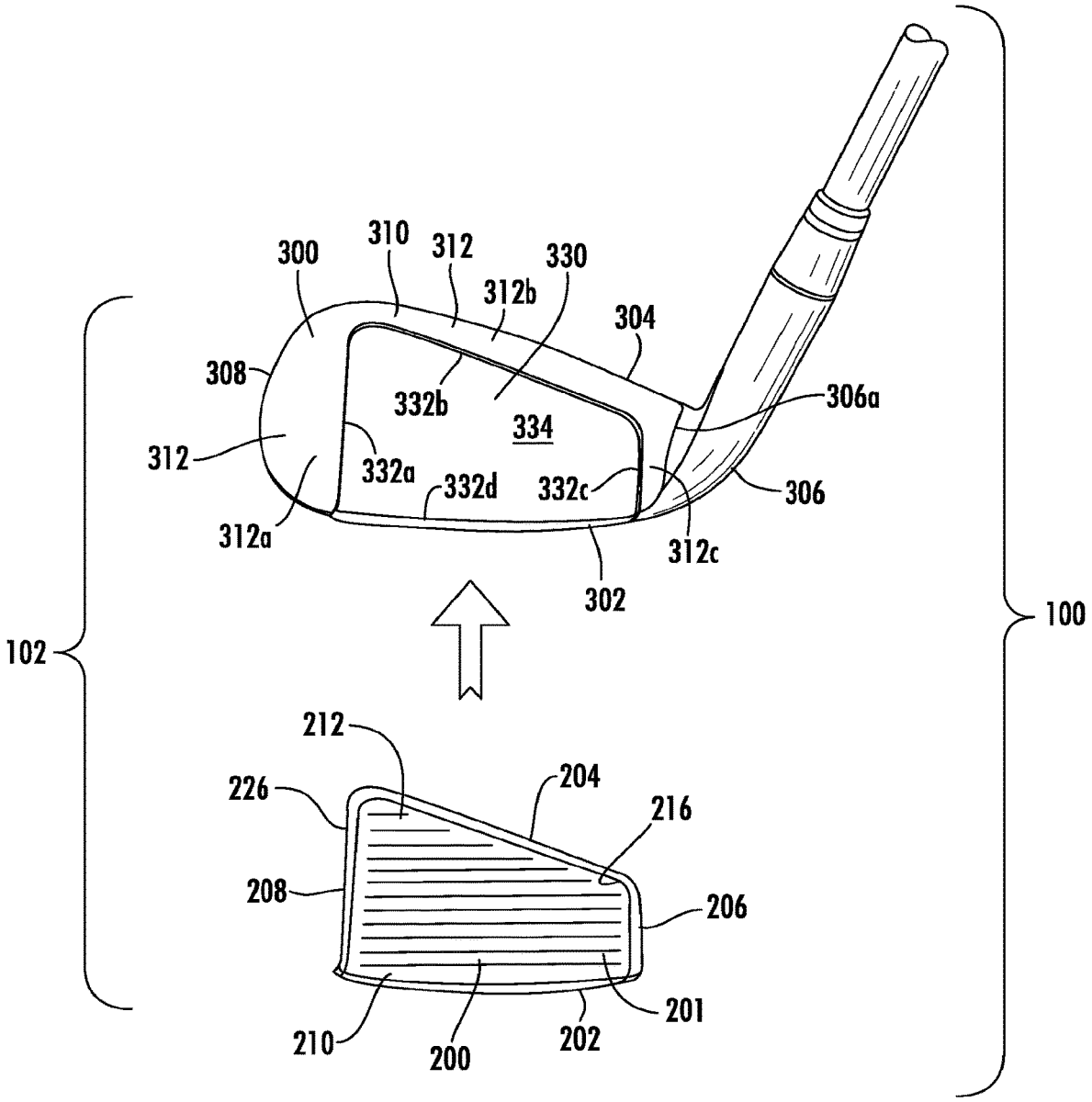
Figure 2C:
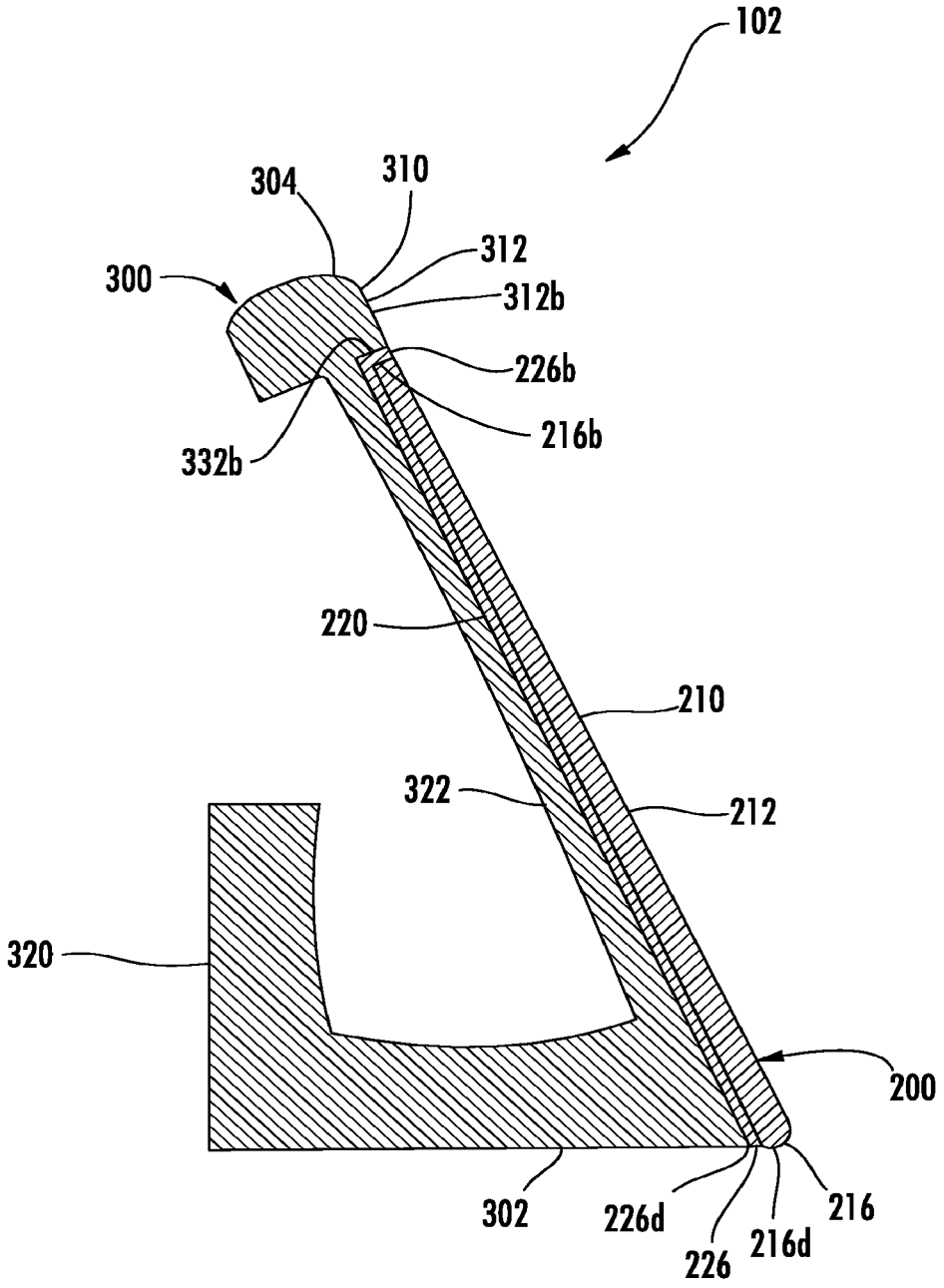

Referring to FIGS. 2A-2D, the iron body 300 includes a sole edge 302, a top edge 304, a heel side 306 and a toe side 308. Further, the iron body 300 includes a front portion 310 and a rear portion 320 (see FIG. 2C). The front portion 310 generally includes that portion of the iron head 102 that faces forward and has a surface designed for contacting the golf ball. Thus, portions of any hosel region that are not designed for contacting the golf ball are not included in the front portion 310, even if such hosel regions have a forward facing surface. In FIGS. 2B and 2C, a heel-side edge 306*a* of front portion 310 is shown. The ball striking plate 200 includes a sole perimeter edge 202, a top perimeter edge 204, a heel-side perimeter edge 206 and a toe-side perimeter edge 208. Further, the ball striking plate 200 includes a face layer 210 and a backing layer 220.

As shown in FIGS. 2A-2D, a recess 330 may be defined in the iron body 300. The front portion 310 of iron body 300 includes a three-sided front frame member 312. Thus, in this particular embodiment, front frame member 312 is formed with a toe-side portion 312*a*, a top portion 312*b* and a heel-side portion 312*c*. Thus, front frame member 312 defines and bounds a recess 330 with three edges 332*a*, 332*b* and 332*c*. A fourth edge 332*d* of recess 330 is not bounded by front frame member 312. Rather, the fourth edge 332*d* of recess 330 is open to and extends along the sole edge 302 of iron body 300.

The illustrated recess 330 is shown with a floor 334 that is generally parallel to the face layer 210 of the ball striking plate 200. However, this is not a requirement. Rather, the floor 334 of the recess 330 can have any desired topography, including sloped and/or stepped, without departing from this invention. Further, in this particular embodiment, the floor 334 of recess 330 is shown without openings. Optionally, however, the floor 334 may have openings, apertures, or cutouts (not shown) that extend through to a rear-facing wall 322 of iron body 300 (see FIG. 2C).

As some more specific examples, the recess 330 may extend in a top-to-bottom direction ranging from 50-100% of the overall iron head height at the location of the recess 330 (and in some examples, from 50-90% or even from 50-80% of the overall top-to-bottom dimension at the location of the recess 330). The recess 330 may extend in a heel-to-toe direction ranging from 50-95% of the overall iron head heel-to-toe length dimension at the location of the recess 330 (and in some examples, from 50-85% or even from 50-75% of the overall heel-to-toe dimension at the location of the recess 330). Further, the recess 330 may have a depth or extend rearward by a distance ranging from approximately 2.0 mm to approximately 8.0 mm, and in some examples, from approximately 4.0 mm to approximately 7.0 mm or even from approximately 3.0 mm to approximately 6.0 mm.

As illustrated in the embodiment of FIG. 2A, the ball striking plate 200 of the iron head 102 may be positioned within recess 330 of iron body 300. As illustrated in FIG. 2B, the ball striking plate 200 and the iron body 300 are shown as separate elements wherein the ball striking plate is configured for insertion into the recess 330 of the iron body 300.

Figure 2D:
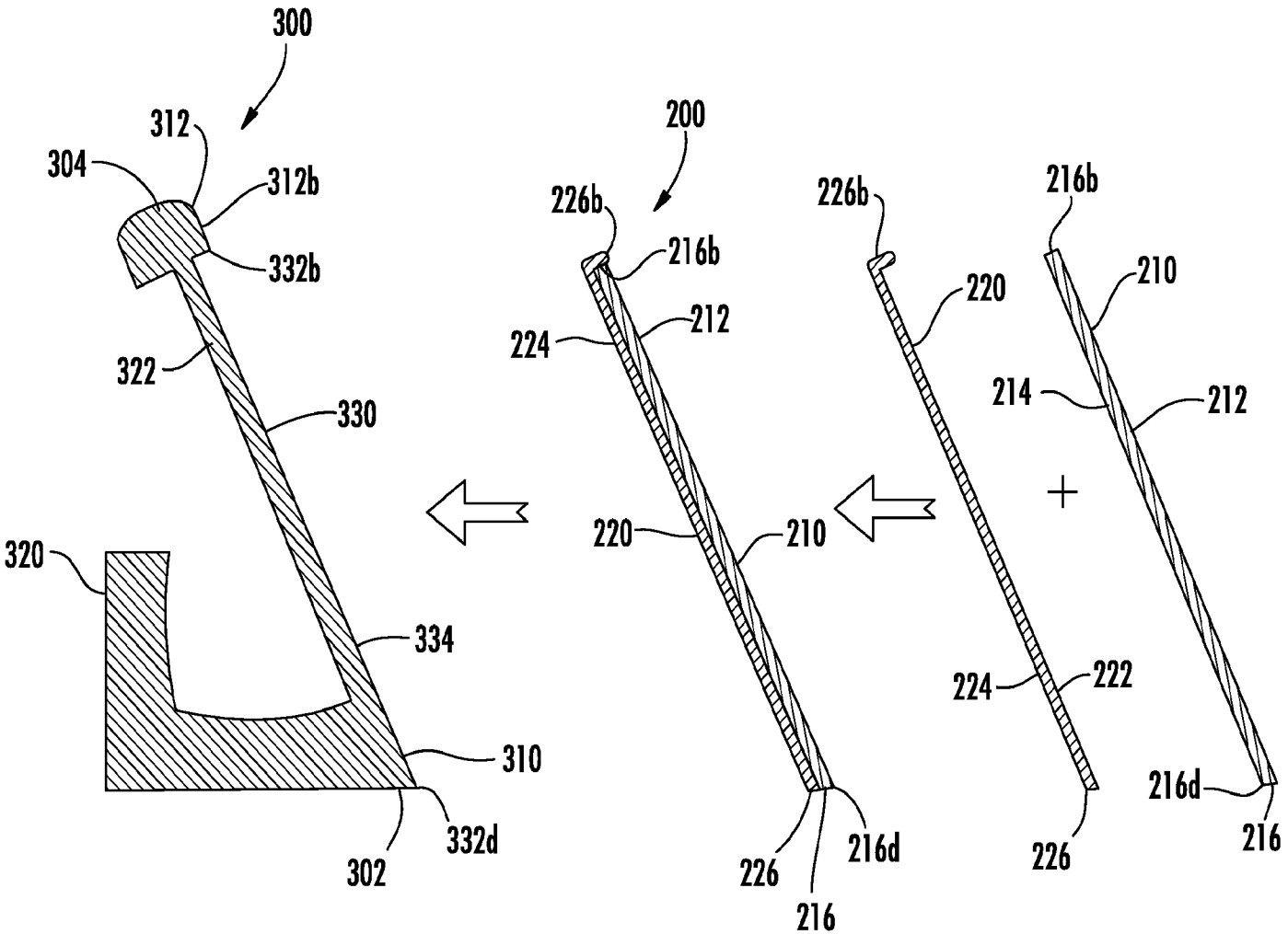

FIG. 2C is a schematic cross-section of iron head 102 taken at line 2C-2C of FIG. 2A. FIG. 2D is an exploded schematic cross-section of FIG. 2C to better show the individual components. Face layer 210 of ball striking plate 200 includes a face surface 212, a rear surface 214 and a perimeter 216. Similarly, backing layer 220 of ball striking plate 200 includes a forward surface 222, a rearward surface 224 and a perimeter 226. Rear surface 214 of face layer 210 is engage to forward surface 222 of backing layer 220. In this embodiment, backing layer 220 extends over the entirety of the rear surface 214 of face layer 210. Further, in this embodiment, the top perimeter edge 226*b* (and also, referring to FIG. 2A, heel-side perimeter edge 226*a* and toe-side perimeter edge 226*b*) of backing layer 220 extends over and frames the perimeter 216 of face layer 210 along perimeter edges 216*a*, 216*b* and 216*c*.

Thus, as best shown in FIGS. 2A and 2C, backing layer 220 is exposed on the front portion 310 of iron head 102. Specifically, the toe-side perimeter edge 226*a* of backing layer 220 is located between toe-side perimeter edge 332*a* of recess 330 and toe-side perimeter edge 216*a* of face layer 210. Similarly, the top perimeter edge 226*b* of backing layer 220 is located between top perimeter edge 332*b* of recess 330 and top perimeter edge 216*b* of face layer 210, and the heel-side perimeter edge 226*c* of backing layer 220 is located between heel-side perimeter edge 332*c* of recess 330 and heel-side perimeter edge 216*c* of face layer 210. In exemplary embodiments, the exposed backing layer 220 may be generally flush with the front face of the front portion 310 of the iron body 300. Further, the exposed backing layer is remote from a central region of the face surface of the face layer.

Junction areas may be defined where perimeter edges 216*a*-216*d* of face layer 210 face or confront the bounding edges 332*a*-332*d* of recess 330. These edges of recess 330 are formed by the interior facing surfaces of front frame member 312. Perimeter edges 216*a*-216*d* may abut and contact bounding edges 332*a*-332*d* of recess 330. Alternatively, a gap between the respective confronting edges of the face layer 210 and the frame member 312 or the recess 330 may be provided. The width of such a gap between the confronting faces may range from approximately 0.5 mm to approximately 2.0 mm. In some example structures, the width of the gap may range from approximately 0.5 mm to 1.5 mm or even from approximately 0.5 mm to 1.0 mm. The gap need not have a constant width or a constant depth. Further, the gap may be unfilled or filled, as discussed below.

Because these perimeter edges 216*a*-216*d* are not directly attached to the iron body 330, the perimeter edges 216 of face layer 210 are essentially decoupled from any displacement and/or rotational constraints that would otherwise be imposed on them by being joined to a stiff structure. Although the perimeter edges 216*a*-216*b* may not be entirely theoretically unconstrained, any constraints imposed by the relatively soft, compliant backing layer 220 would be minimal and for all practical purposes the perimeter edges 216*a*-216*d* may be considered to be free. Thus, when the ball striking plate 200 strikes a golf ball, the perimeter edges 216*a*-216*d* of the face layer 210 may flex and displace substantially freely. Further, it is expected that the stresses at the perimeter edges 216*a*-216*d* may be essentially zero.

At the bottom edge 302 of iron body 300 there is no front frame member portion. Further, at the bottom perimeter edge 216*d* of face layer 210, the backing layer 220 does not extend over and frame the bottom perimeter edge 216*d*. Rather, the bottom perimeter edge 216*d* of face layer 210 is exposed (i.e., visible) and the bottom perimeter edge 226*d* of backing layer 220 is also exposed and visible from the bottom of the iron head 102 (as opposed to being exposed on the front portion 310).

The thickness of the backing layer 220 may range from approximately 0.5 mm to approximately 3.0 mm. In some example structures in accordance with this invention, the thickness of the backing layer 220 may range from approximately 0.5 mm to 2.0 mm or even from approximately 0.5 mm to 1.0 mm. The thickness may be constant or it may vary.

The width of the framing material of the backing layer 220 that is exposed and visible on the iron face 310 may range from approximately 0.5 mm to approximately 2.0 mm. In some example structures in accordance with this invention, the width of the exposed material at the iron face may range from approximately 0.5 mm to 1.5 mm or even from approximately 0.5 mm to 1.0 mm.

In this particular embodiment, face layer 210, backing layer 220 and floor 334 of recess 330 are all substantially planar. Further, in this particular embodiment, the thickness of face layer 210 is substantially constant. Even further, the thickness of backing layer 220 (with the exception of the thin perimeter edges 226*a*, 226*b* and 226*c* which are thicker to thereby extend upward around the perimeter edges of the face layer 210) is substantially constant, and the width of portion of the backing member framing the face layer 210 is substantially constant.

According to some aspects and as shown in this particular embodiment, the thickness of the face layer 210 may be greater than the thickness of the backing layer 220. For example, the thickness of the face layer 210 may be 125%, 150%, or even approximately double that of the backing layer 220. In other embodiments, the thickness of the face layer 210 may be approximately equal to the thickness of the backing layer 220. In even other embodiments, the thickness of the face layer 210 may be less than the thickness of the backing layer 220. For example, the thickness of the face layer 210 may be 90%, 75%, or even 50% of the thickness of the backing layer 220.

Further, according to other aspects, the face layer 210 may extend completely over the entire region between its perimeter edges 216*a*-216*d*. In other words, face layer 210 may be formed without any through-openings, e.g., apertures, holes, slots or cutouts that extend completely through the face layer 210 from the face surface 212 to the rear surface 214. Face layer 210 may include part-through features such as grooves, indentations, surface texture, etc., on its face surface 212. Such features may enhance the interaction between the club head and the golf ball. Further, face layer 210 may include part-through features (not shown) on its rear surface 214, which may for example enhance the cooperation between the face layer 210 and the backing layer 220.

According to certain embodiments, face layer 210 may be formed without any through-openings in the desired-contact region. In even other embodiments, face layer 210 may be formed without any through-openings in an interior intermediate region extending around the desired-contact region. Such an intermediate region may extend from the desired-contact region to within a predetermined distance of the edges 302, 304, 306*a*, 308 of the iron body 300. The predetermined distance from the edges of the iron body to the boundary of the intermediate region may be less than 5 mm. Optionally, the predetermined distance may be less than 8 mm, less than 10 mm, or even limited to less than 12 mm. Alternatively, the intermediate region formed without any through-openings may be defined as extending to within 15%, or even extending to within 10%, of the edge-to-edge distance of the face layer 210. A central region of the face layer may include both the desired-contract region and the interior, intermediate region. Thus, according to certain embodiments, the central region may be void of through-openings. By prohibiting openings within the central region of the face layer 210, stress concentrations may be minimized and the resulting lower stresses may allow for a relatively thinner face layer. In some embodiments, through-openings or other discontinuities may be provided in the perimeter regions (e.g., beyond the boundary of the intermediate region) of the face layer 210, where stresses are expected to be lower.

As illustrated in FIG. 2D, in this example structure, the face layer 210 and the backing layer 220 may be engaged to one another to form the ball striking plate 200. As an example, backing layer 220 may be adhesively bonded to face layer 210. Further, as illustrated in FIGS. 2C and 2D, ball striking plate 200 may be located within recess 330 of iron body 300 such that backing layer 220 is engaged to iron body 300. For example, backing layer 220 may be adhesively bonded to floor 334 and/or to recess perimeter edge 332 as bounded by front frame member 312. As such, backing layer 220 is sandwiched between the face layer 210 and the iron body 330.

Selecting the materials and the geometries (thicknesses, shapes, sizes, etc.) of the face layer 210 and the backing layer 220 allows a greater degree of flexibility in altering and controlling the ball strike characteristics of the iron head 102. As discussed above, the COR may be improved and/or an improved COR may extend over a larger area of the ball striking surface. Thus, the desired-contact region may be increased and the club head may be made more forgiving of off-center hits. Further, characteristics which affect the "feel" characteristics of the iron head (e.g., by damping vibrations and altering the sound of a ball strike) may be better controlled.

For example, a first desired-contact region may be defined as the area of the ball striking plate that is capable of achieving at least 99.7% of the maximum ball speed achievable by the ball striking device and this desired-contact region may have an area generally ranging from approximately 150 $mm^2$ to approximately 200 $mm^2$. Optionally, a second desired-contact region may be defined as the area of the ball striking plate that is capable of achieving at least 99.5% of the maximum ball speed achievable by the ball striking device and this desired-contact region may have an area generally ranging from approximately 250 $mm^2$ to approximately 300 $mm^2$. Alternatively, a third desired-contact region may be defined as the area of the ball striking plate that is capable of achieving at least 99.0% of the maximum ball speed achievable by the ball striking device and this desired-contact region may have an area generally ranging from approximately 200 $mm^2$ to approximately 250 $mm^2$.

Further, according to the embodiment of FIGS. 2A-2D, the face layer 210 may be formed of a metal such as stainless steel, titanium, aluminum, and their alloys, and the like. In some examples, the face layer 210 may be formed of titanium alloys or stainless steel and may be between approximately 1.0 mm and approximately 4.0 mm thick and, in some examples, the face layer 210 may be between approximately 2.0 to approximately 3.0 mm thick.

The backing layer 220 may be formed of a polymeric material such as thermoplastic polyurethane or a thermoset material. The backing layer 220 may have a hardness range between 25 and 85 Shore D. In some specific examples, the backing layer may have a hardness range between 35 and 45 Shore D, 50 and 60 Shore D or 60 and 70 Shore D.

The combination of metal forming the face layer 210 and a polymeric material forming the backing layer 220 of the ball striking plate 200 may provide improved performance of the golf club including higher COR, a larger desired-contact region, softer feel, more control over the ball trajectory, a more metallic ball striking sound, etc.

As disclosed above, iron body 300 may be made from any desired materials without departing from this invention, including, for example, metals, metal alloys, polymeric materials, ceramics, etc. and the like, including materials that are conventionally known and used in the art. Conventional methods of forming the iron body known in the art can also be used. Further, iron body 300 may be made from one or multiple independent pieces or parts. If made from multiple pieces, these sub-components may be detachably joined or integrally joined to form iron body 300. Conventional means for forming the individual components or sub-components and for joining the parts may be used to form iron body 300.

Recess 330 may be formed in the iron body 300 in any desired manner without departing from this invention, including, for example, forming the iron body 300 to include such a recess 330 during the molding, casting, forging, or other production process of the iron body 300, forming the recess 330 by joining various sub-components of the iron body 300 together, or machining such a recess 330 after the iron body 300 has been generally formed. Further, recess 330 may be formed with one or more unframed edges. Thus, for example, recess 330 may be framed on three sides with one unframed edge. The unframed edge may be on the top, bottom, heel-side, toe-side, etc. As another example, the recess 330 may be framed on two sides with two unframed edges. The unframed sides may be opposite one another (e.g., on the top and on the bottom) or adjacent to one another (e.g., on the top and on the heel-side). As another example, the recess 330 may be framed on a single side (e.g., the bottom edge of the iron head 102). In even other embodiments, the recess 330 may be framed along portions of the club head edges. Thus, as another example, the recess 330 may include a frame that extends along the top edge and partially down along the heel-side and/or the toe-side edges. As even other example, the recess 330 may be framed at one or more corners, but not along the central portions of the edges (or vice versa). Thus, the frame need not be continuous. Discontinuities or gaps (or shortened portions of a frame along the edges of the club head) may be provided. Additionally or alternatively, if desired, portions of the balls striking plate may lie between the discontinuous portions of the frame.

Aspects of this invention may be practiced with any desired iron head construction without departing from this invention. For example, aspects of this invention may be practiced with blade-type iron heads, muscle-back-type iron heads, cavity-back-type iron heads, etc. Further, it is understood that the invention is not limited to use in the various golf club constructions disclosed. Rather, aspects of this invention may be used in the construction of any desired golf club construction and styles and types that are known and used in the art.

FIG. 2D generally illustrates one manner of making iron heads in accordance with examples of this invention. The method includes providing or obtaining an iron body 300. The iron body 330 may be provided in any desired manner without departing from the invention, such as by machining, by molding or casting, by forging, etc. The iron body 300 includes recess 330 which is defined at least in part by front frame member 312. Recess 330 may be provided or formed in the iron body 330 in any desired manner without departing from the invention, such as by machining, by molding or casting, by forging, etc. A face layer 210 formed of a metallic material is provided. The face layer 210 may be provided in any desired manner without departing from the invention, such as by machining, by molding or casting, by forging, etc. The face layer 210 may have various grooves (not shown) and/or textures (not shown) provided on its face surface 212. Optionally, such grooves or textures may be provided in a subsequent process step. Further, the face layer 210 may be provided with any of various bulge, roll, etc. characteristics, as are known in the art. In exemplary embodiments, the face layer 210 may be free from through openings or other passages that would extend completely through the face layer 210. A backing layer 220 is provided. In this particular embodiment, a pre-formed backing layer 220 formed of a polymeric material is provided. The pre-formed backing layer 220 may be provided in any desired manner without departing from the invention, such as by machining, by molding or casting, by drawing, etc. Backing layer 220 includes a perimeter edge 226 which complementarily matches the perimeter edge 216 of face layer 210 and which also complementarily matches the recess perimeter edge 332 bounded by front frame member 312. The forward surface 222 of backing layer 220 is engaged to the rear surface 214 of face layer 210 with an adhesive member. For example, the adhesive member may include an epoxy-type adhesive or an acrylic-type adhesive (such as cyanoacrylate). The rearward surface 224 of backing layer 220 is engaged to the floor 334 of recess 330 of iron body 300 with an adhesive member. The assembled iron head 102 may be further processed in any desired manner, e.g., by painting, anodizing, or other finishing processing; by cutting score-lines or grooves into the face layer 210 of the iron head 102 (e.g., as described above); by adding a shaft 110 and/or grip member to the club head; etc.

According to an alternative method, if desired, prior to introducing the backing layer 220, the iron body 300 (or at least some portions thereof) may be fit into a mold or other suitable structure to hold a precursor liquid polymer of the backing layer 220 in place (and optionally, if desired, to form gaps between the iron body 300 and the face layer 210 into which the polymer may flow). The polymeric material may be introduced by pouring, by injection molding processes (e.g., under pressure), or the like. Once introduced, if necessary, the polymeric material forming the backing layer 220 may be exposed to conditions that enable it to harden and/or cure, such as to cool temperatures; to high temperatures; to pressure; to ultraviolet, infrared, or other radiation; etc. According to this alternative method, the steps of engaging the backing layer 220 to the floor 334 and/or to the rear surface 214 of the face layer 210 with an adhesive member, as disclosed above, may be eliminated. If necessary or desired, the rear surface 214 of the face layer 210 may be treated, shaped or textured to help the polymeric backing layer 220 adhere to it.

Figure 3A:
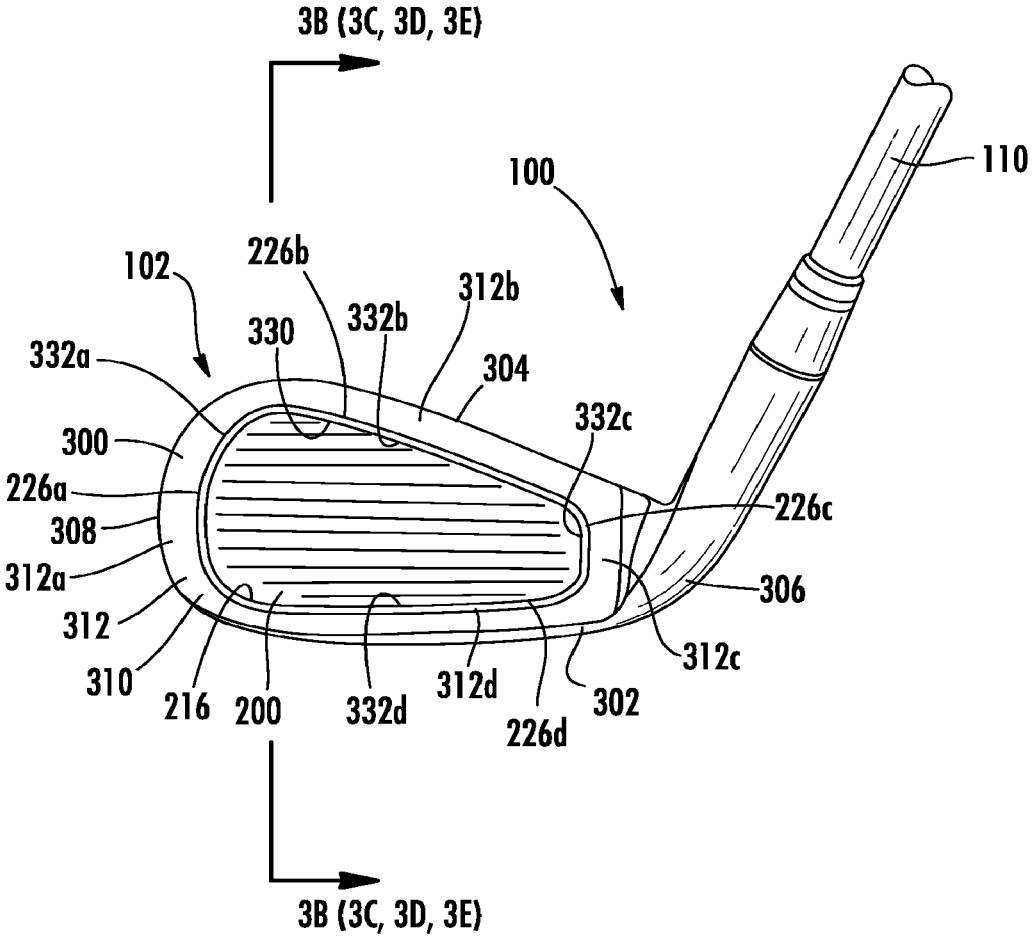
FIGS. 3A through 3E illustrate alternative embodiments of an iron club in accordance with at least some aspects of this invention.
Figure 3B:
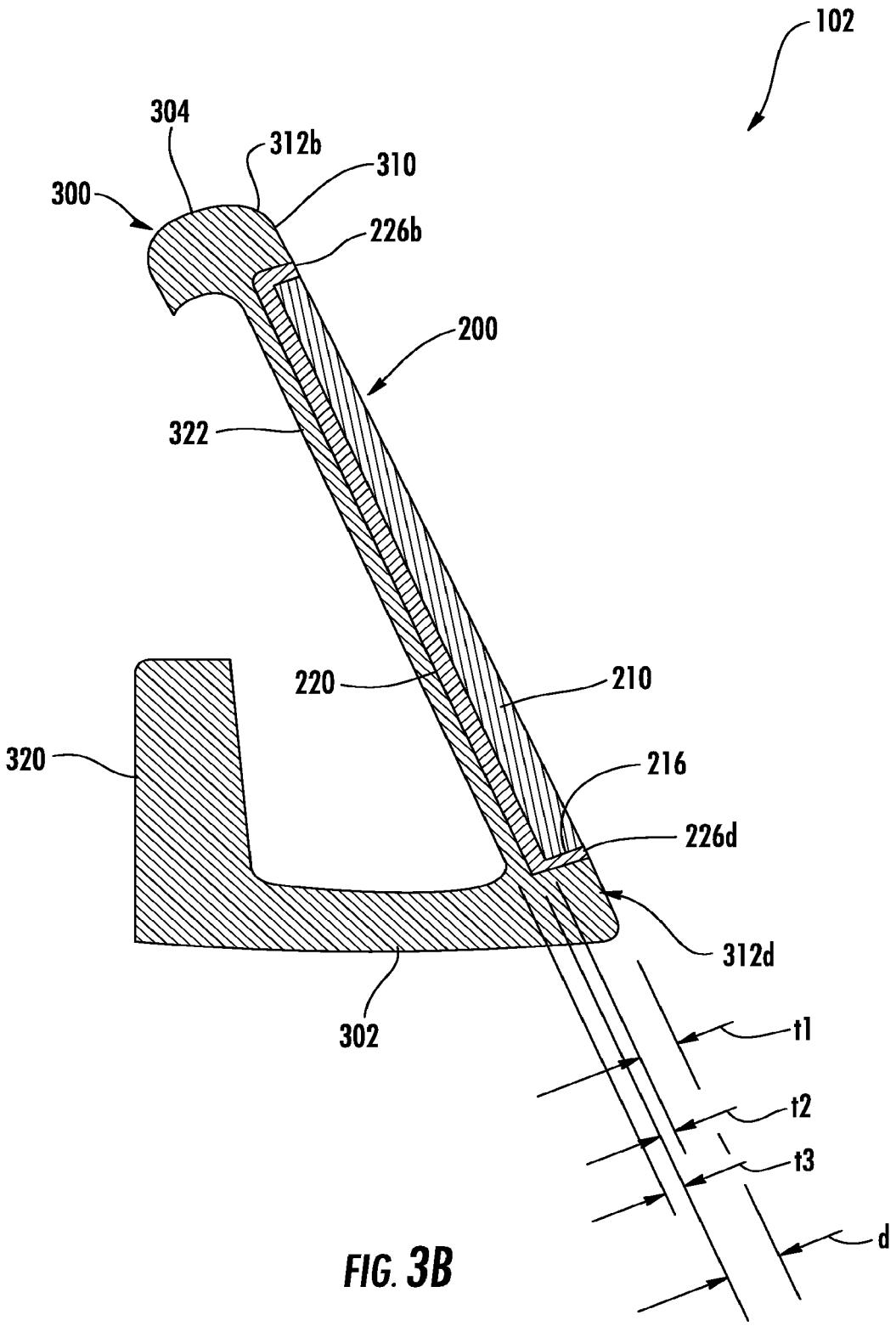

Other club constructions are possible without departing from this invention, and FIGS. 3A and 3B illustrate another example golf club head for use with a golf club, such as an iron. Similar to the arrangements described above, the golf club head includes an iron body 300 and a ball striking plate 200 engaged within a recess 330, which is formed in the front portion 310 of the iron body 300. The ball striking plate 200 may be shaped to correspond to the shape of the recess 330 (i.e., shaped to complementarily match the shape of the recess) and may be configured to be received in the recess 300.

In the arrangement of FIGS. 3A and 3B, the recess 300 is completely surrounded by the front frame member 312. Front frame member includes a toe-side portion 312*a*, a top portion 312*b*, a heel-side portion 312*c*, and a bottom portion 312*d*. Thus, in this particular embodiment, front frame member 312 defines and bounds a recess 330 having four edges 332*a*, 332*b*, 332*c* and 332*d*. Further, in this example, embodiment, front frame member 312 forms a continuous frame adjacent the perimeter of the iron body 300 and around the perimeter of the recess 330. Front frame member 312 has a substantially constant width, and thus, the perimeter of recess 330 has a substantially complementary shape (although smaller in size) to the perimeter of the iron head 102.

FIG. 3B is a schematic cross-section of the iron head 102 of FIG. 3A taken at line 3B-3B. In this embodiment, the top perimeter edge 226*b* and the bottom perimeter edge 226*d* (and also, referring to FIG. 3A, the toe-side perimeter edge 226*a* and the heel-side perimeter edge 226*c*) of backing layer 220 extends along perimeter 216 of face layer 210. In this illustrated example structure, the frame-like perimeter edge 226 of the backing layer 220 is exposed and is visible around the entire 360° perimeter edge 216 of the face layer 210.

Further, in this particular embodiment, the thickness, t1, of the face layer 210 is substantially constant and the face layer 210 is substantially planar. The thickness, t2, of the backing layer 220 is substantially constant and the backing layer 220 is substantially planar. Further, the thickness, t3, of the rear-facing wall 322 of the iron body 300 is substantially constant. Finally, the depth, d, of the recess 330 is substantially constant.

Figure 3C:
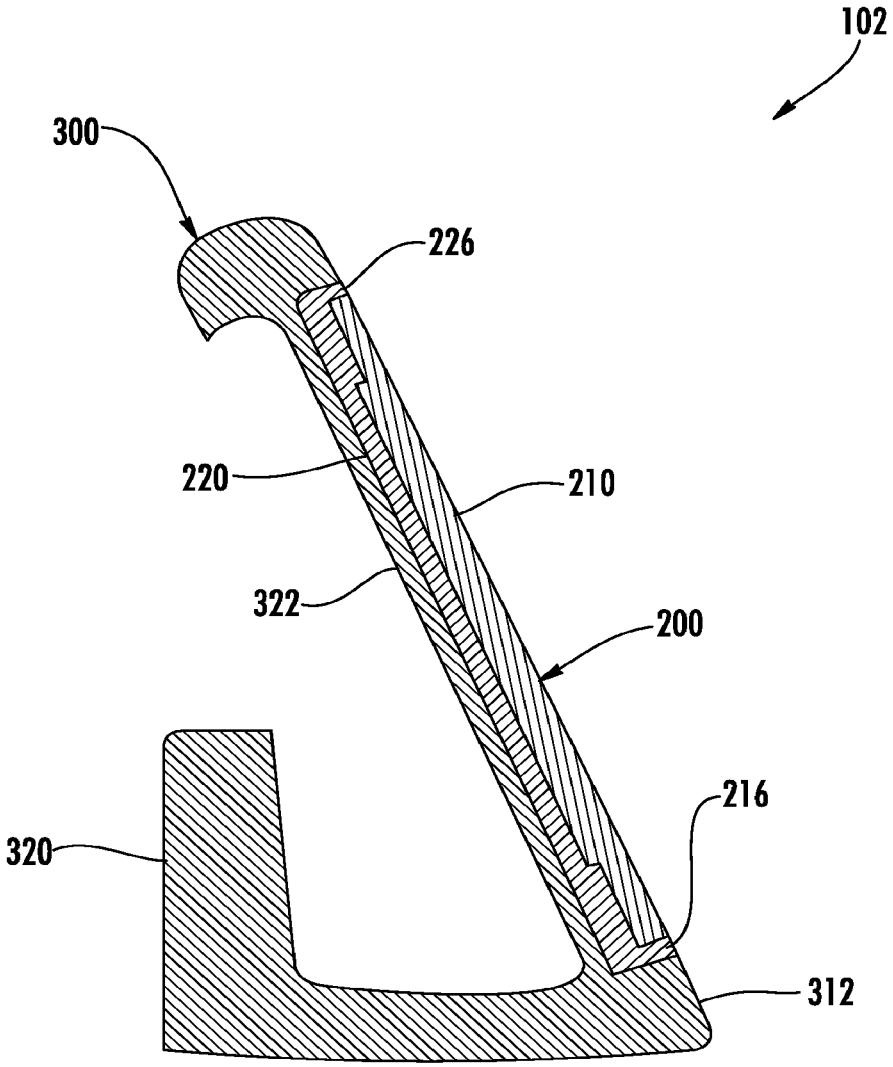

FIG. 3C is a schematic of an alternative cross-section of the iron head 102 of FIG. 3A taken at the alternatively labeled line 3C-3C. In this alternative embodiment, the thickness of the backing layer 220 varies. A first, greater thickness is provided adjacent to the frame-like perimeter edge 226. A second, thinner thickness is provided across the middle portion of the face layer 210. An abrupt step-change occurs between the first thickness and the second thickness of the backing layer 220. Correspondingly, in this alternative embodiment, the thickness of the face layer 210 varies. A first, thinner portion is provided adjacent to the perimeter 216, while a second, thicker portion extends across the central region of the face layer 210. The thickness of the rear-facing wall 322 of the iron body 300 is substantially constant. Further, the depth of the recess 330 is substantially constant.

Figure 3D:
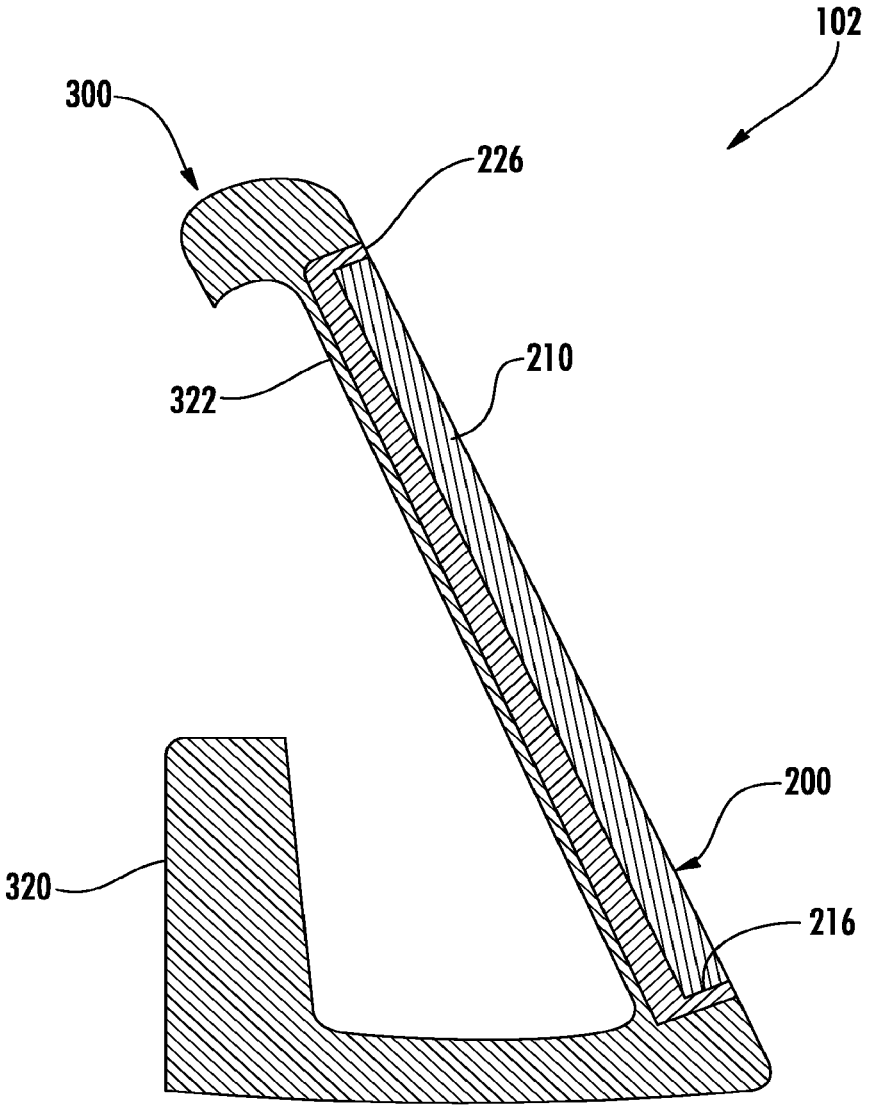

FIG. 3D is a schematic of even another alternative cross-section of the iron head 102 of FIG. 3A taken at the alternatively labeled line 3D-3D. In this alternative embodiment, the thickness of the backing layer 220 varies gradually, from thinner at the top to thicker at the bottom. The thickness of the face layer 210 is constant, as is the thickness of the rear-facing wall 332 of the iron body 300. The depth of the recess 330 is approximately equal to the combined thicknesses of the backing layer 220 and the face layer. Thus, the depth of the recess also varies gradually, from thinner at the top to thicker at the bottom.

Figure 3E:
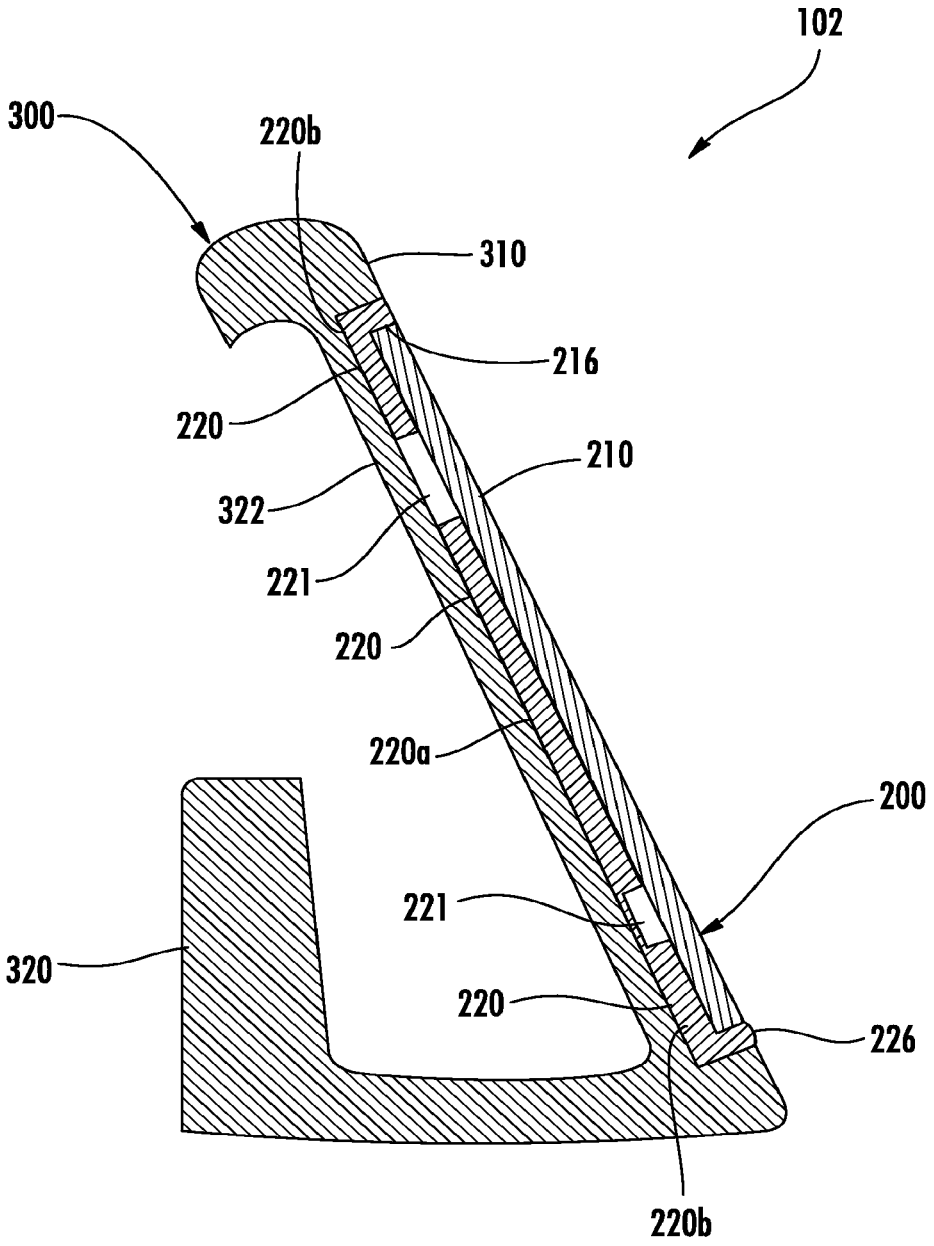

FIG. 3E is a schematic of even another alternative cross-section of the iron head 102 of FIG. 3A taken at the alternatively labeled line 3E-3E. In this alternative embodiment, the thickness of the backing layer 220 is substantially constant, but the backing layer 220 is discontinuous. Thus, in the particular example illustrated in FIG. 3E, backing layer 220 includes a central portion 220*a* separated by a gap 221 from a perimeter portion 220*b*. According to some embodiments, the material forming one portion of backing layer 220 (e.g., central portion 220*a*) may be different from the material forming a second region of backing layer 220 (e.g., perimeter portion 220*b*).

Thus, it can be seen from these few embodiments, that any of various thicknesses, whether constant or varying, and any of various configurations, whether continuous or discontinuous, may be accommodated by the face layer 210, the backing layer 220, the ball striking plate 200, and/or rear-facing wall 322 of the iron body 300 and still be in keeping with the invention disclosed herein.

Figure 4A:
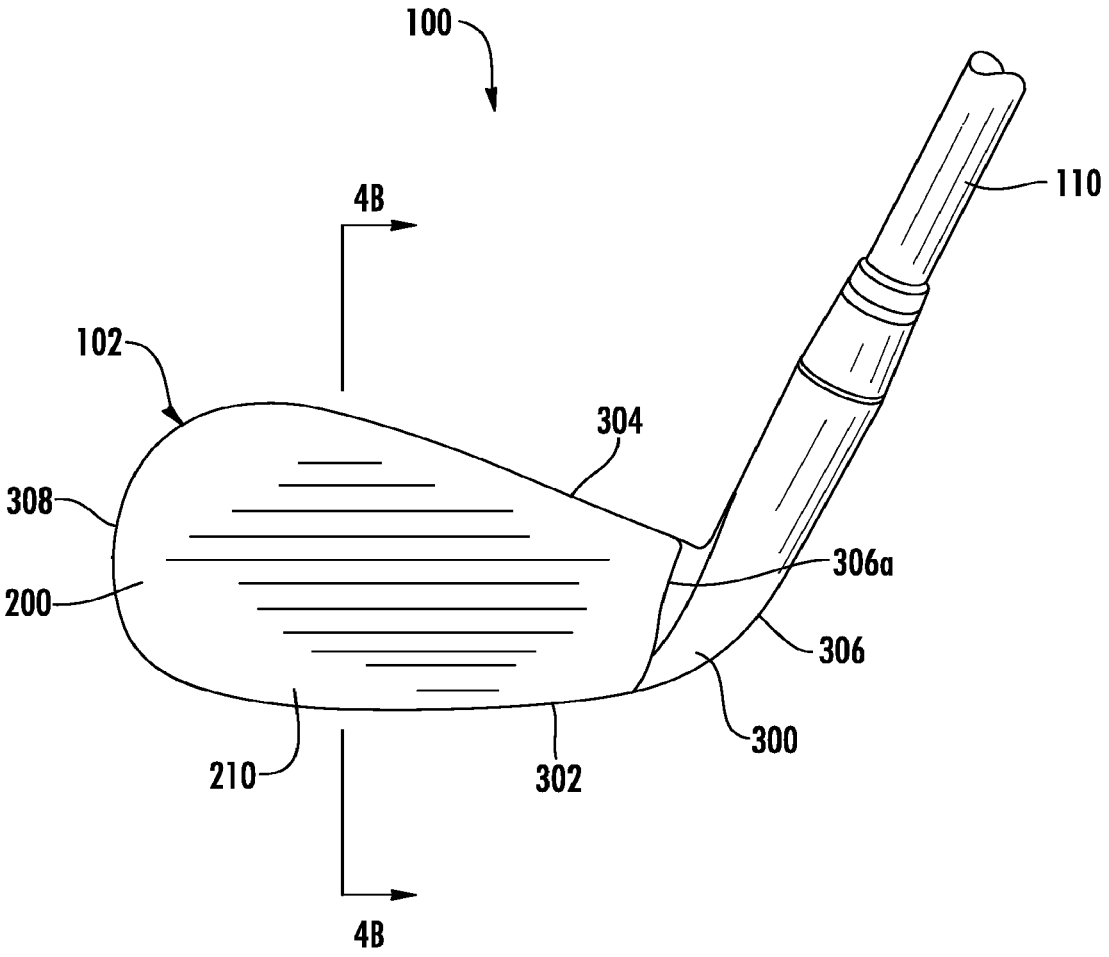
FIGS. 4A through 4B illustrate another alternative embodiment of an iron club in accordance with some further aspects of this invention.
Figure 4B:
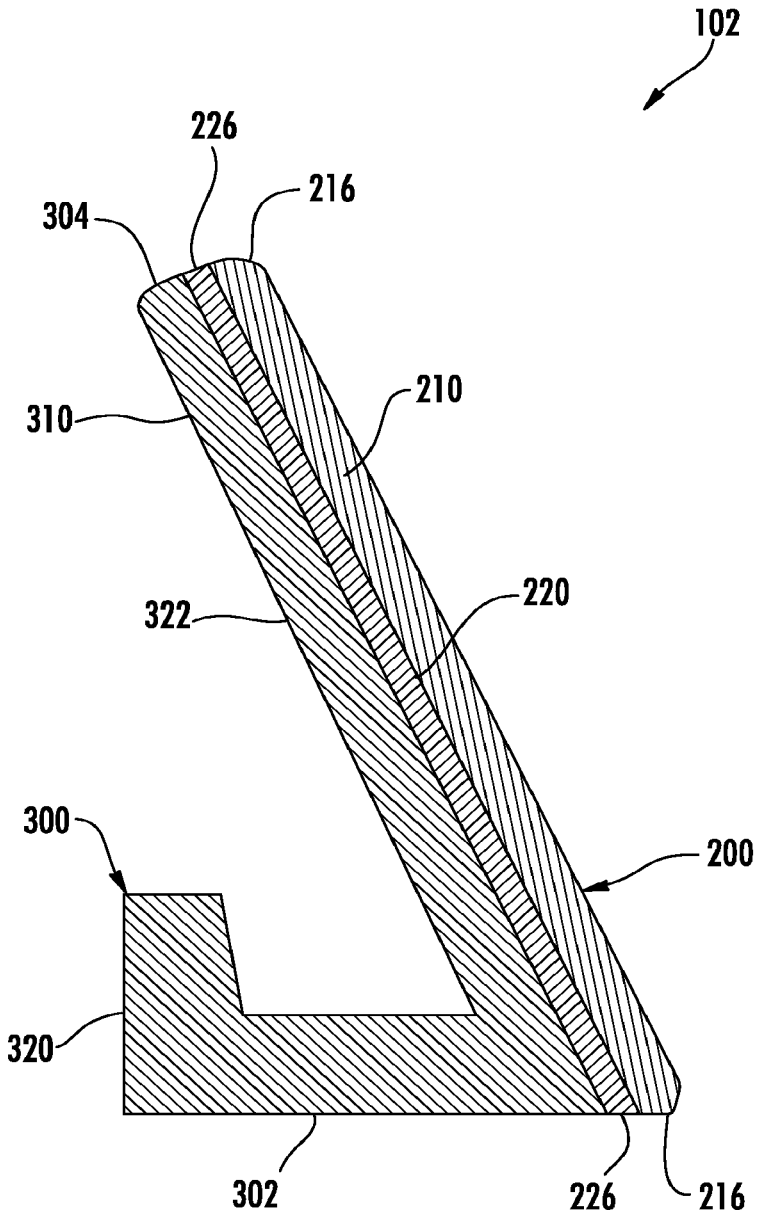

According to other aspects, as shown in FIGS. 4A-4B, the iron body 300 need not be provided with a recess for receiving the ball striking plate 200. In other words, the iron body 300 need not include a frame 312 on the front portion 310. Thus, in one embodiment, the ball striking plate 200 may be located on the front portion 310 of the iron body 300 as shown in FIGS. 4A-4B. The ball striking plate 200 may extend from a toe edge 308 to a heel edge 306*a* of the face portion (i.e., excluding the hosel region) of the iron head 102. Further, the ball striking plate 200 may extend from a top edge 304 to a bottom edge 302 of the iron head 102. FIGS. 4A-4B illustrate one example golf club head in which a face layer 210 of the ball striking plate 200 forms the entire front face 310 of the face portion of the iron head 102 (i.e., excluding the hosel region).

The example structure shown in FIG. 4A includes a ball striking plate 200 that covers substantially the entirety of the front portion 310 of the iron body. The ball striking plate 200 includes a face layer 210 formed of a first material. The ball striking plate 200 also includes a backing layer 220, e.g., that may be co-molded to the face layer 210 or otherwise engaged therewith (e.g., as described above) to form the ball striking plate 200. The backing layer 220 may be formed of a polymeric material. In some arrangements, the first material forming the face layer 210 may be a metal material, while the second material forming the backing layer 220 may be a highly-elastic polymer.

The backing layer 220 may be coextensive with the face layer 210. Alternatively, the backing layer 220 may extend over only a portion of the face layer 210. Thus, for example, the backing layer 220 may extend over approximately 50% to approximately 90% of the total area of the rear surface of the face layer 210. Further, the backing layer 220 may be continuous or discontinuous, of constant or varying thickness, or of multiple materials.

In the embodiment of FIGS. 4A-4B, the perimeter edge 226 of the backing layer 220 is not exposed on or visible from the front face of the iron head 102. Rather, the perimeter edge 226 of the backing layer 220 may be exposed along the edges 302, 304, 308 of the iron head 102 and along the edge 306*a* of the front portion 310.

The ball striking plate 200 may be engaged with or connected to the iron body 300 using various techniques, including conventional engagement or connection techniques as are known and used in the art. For instance, similar to the arrangements described above, the ball striking plate 200 may be engaged with the golf club head using adhesives, cements, double-sided tapes, etc. Other connection arrangements, including releasable and/or interchangeable connection arrangements, may be used without departing from this invention.

In some examples, the ball striking plate 200 may be removable to allow for customization and/or personalization of the ball striking plate 200 and/or golf club head. For instance, the ball striking plate 200 may be releasably connected to the golf club head using a releasable adhesive. Personalization and customization features may include various characteristics such as polymer and/or metal hardness (e.g., harder or softer for different play conditions or swing types); polymer color (e.g., team colors, color associated with a cause or promotion, player preference, etc.); etc.

In some embodiments, the backing layer 220 may also act as a gasket when the face layer 210 is connected to the golf club head. For instance, the material forming the backing layer 220 may aid in sealing the ball striking plate 200 to the iron body 300 in order to prevent moisture, debris, etc. from collecting between the ball striking plate 200 and the iron body 300.

As disclosed herein, the ball striking plate 200 may include a backing layer 220 of polymer, such that the face layer 210 may be considered as being suspended or floating on the polymer layer. With such construction, a higher COR may be achieved in the desired-contact region, while minimizing stresses and/or strains. In addition, a higher COR may also be achieved along the perimeter regions of the ball striking plate 200, e.g., at the junction areas where the respective edges of the face layer 210 confront the respective edges of the front frame member 312 of the iron body 300. Upon impact with a golf ball, the backing layer 220 may provide for an optimum amount of flexing or elastic deflection of the ball striking plate 200 for a given face layer 210. Additionally, the face layer 210, which experiences lower stresses at the perimeter edges may be designed to provide for an optimum amount of flexing or elastic deflection of the ball striking plate 200 for a given backing layer 220. This may result in higher ball speed, increased distanced for the ball, and/or a more forgiving club.

As described above, irons and iron heads may have any desired constructions, materials, dimensions, loft angles, lie angles, colors, designs, and the like without departing from this invention. A ball striking plate for inclusion in an iron head has been described. Advantageously, the ball striking plate includes a backing layer that may be made from a material that is softer and lighter than the material of a face layer. Further, the material of the backing layer may be softer and lighter than the material(s) of the iron body with which it is engaged. The softness of the backing layer material may help provide a desirable "feel" when a ball is contacted by the iron, and the lightness of the material may enable the club designer to provide additional weight elsewhere in the overall iron structure (e.g., low, rearward, and/or toward the outside of the overall iron structure, to thereby increase the iron's moment of inertia and resistance to twisting about a vertical axis, to control the center of gravity location, etc.). Also, if desired, the backing layer may be made a different color from other parts of the iron structure (e.g., different from the face layer and/or the iron body) so that the exposed polymeric material stands out, to provide an interesting aesthetic appearance to the iron structure.

Moreover, the combination of a metallic face layer and polymeric backing layer may provide a consistent feel (optionally controllable by selecting the hardnesses and/or stiffnesses of the various parts) while still providing a high coefficient of restitution. Further, the area of the ball striking surface having a high coefficient of restitution may be increased, thereby providing a more forgiving club. Other advantages may become apparent.

CONCLUSION

Modifications to the iron and iron head structures and/or methods for making these structures may be used without departing from the invention. For example, different types of iron heads, shafts, grips, and/or other structural elements may be provided and/or modified without departing from the invention. With respect to the methods, additional production steps may be added, various described steps may be omitted, steps may be changed and/or changed in order, and the like, without departing from the invention. Therefore, while the invention has been described with respect to specific examples including presently preferred modes of carrying out the invention, those skilled in the art may appreciate that there are numerous variations and permutations of the above described structures and methods. Thus, the spirit and scope of the invention should be construed broadly as set forth in the appended claims.

What is claimed:

1. An iron type golf club head, comprising:
an iron body having a heel side, a toe side, a rear portion, and a front portion;
the front portion comprising:
a front surface, the front surface comprising:
a top portion;
a heel-side portion;
a toe-side portion;
a frame formed from the top portion, the heel-side portion, and the toe-side portion, the frame comprising bounding edges forming a recess;
wherein the recess comprises a recess depth and a recess floor;
wherein the recess depth extends rearwardly toward the rear portion in a range from 2.0 mm to 8.0 mm; and
wherein the recess floor extends parallel to the front surface;
a ball striking surface configured to be received within the recess, wherein the ball striking surface comprises a perimeter edge;
wherein the ball striking surface comprises a minimum thickness greater than approximately 0.5 mm;
a discontinuous backing layer affixed behind the ball striking surface by an adhesive;
wherein the backing layer separates at least a portion of the ball striking surface from the heel-side portion and the toe-side portion;
wherein the frame does not extend completely around the perimeter edge of the ball striking surface.

2. The iron type golf club head of claim 1, wherein:
the discontinuous backing layer further comprises:
a central portion; and
a perimeter portion;
wherein the central portion and the perimeter portion of the discontinuous backing layer are separated by a gap.

3. The iron type golf club head of claim 2, wherein:
the central portion comprises a first material;
the perimeter portion comprises a second material; and
the first material is different from the second material.

4. The iron type golf club head of claim 1, wherein:
the discontinuous backing layer has a varying thickness.

5. The iron type golf club head of claim 1, wherein:
the discontinuous backing layer includes a highly elastic polymeric material.

6. The iron type golf club head of claim 1, wherein:
the discontinuous backing layer includes a viscoelastic polymeric material.

7. The iron type golf club head of claim 1, wherein:
the discontinuous backing layer comprises a laminate including a plurality of thin laminae.

8. The iron type of golf club head of claim 7, wherein:
the plurality of thin laminae comprise at least one layer of a highly elastic material.

9. The iron type of golf club head of claim 8, wherein:
the plurality of thin laminae comprise at least one layer of a viscoelastic material.

10. The iron type of golf club head of claim 9, wherein:
the plurality of thin laminae comprise at least one layer of a non-polymeric material.

11. An iron type golf club head, comprising:
an iron body having a heel side, a toe side, a rear portion, and a front portion;
the front portion comprising:
a front surface, the front surface comprising:
a top portion;
a heel-side portion;
a toe-side portion;
a frame formed from the top portion, the heel-side portion, and the toe-side portion, the frame comprising bounding edges forming a recess;
wherein the recess comprises a recess depth and a recess floor;
wherein the recess depth extends rearwardly toward the rear portion in a range from 2.0 mm to 8.0 mm; and
wherein the recess floor extends parallel to the front surface;
a ball striking surface comprising a face layer, the ball striking surface configured to be received within the recess, wherein the ball striking surface comprises a perimeter edge;
wherein the ball striking surface comprises a minimum thickness greater than approximately 0.5 mm;
a discontinuous backing layer affixed behind the ball striking surface by an adhesive;
wherein:
the face layer comprises a laminate including a plurality of thin sub-layers;
the discontinuous backing layer comprises a laminate including a plurality of laminae;

the backing layer separates at least a portion of the ball striking surface from the heel-side portion and the toe-side portion;

the frame does not extend completely around the perimeter edge of the ball striking surface.

12. The iron type golf club head of claim 11, wherein:

the discontinuous backing layer has a varying thickness.

13. The iron type golf club head of 11, wherein:

the face layer comprises at least one thin sub-layer of a metal.

14. The iron type golf club head of 11, wherein:

the plurality of thin sub-layers comprises a first thin sub-layer; and the plurality of thin sub-layers comprises a second thin sub-layer.

15. The iron type golf club head of 14, wherein:

the first thin sub-layer is provided in a contact region; and the second thin sub-layer is provided around the first thin sub-layer.

16. The iron type of golf club head of 11, wherein:

the plurality of thin laminae comprise at least one layer of a highly elastic polymeric material.

17. The iron type of golf club head of 11, wherein:

the plurality of thin laminae comprise at least one layer of a viscoelastic polymeric material.

18. The iron type of golf club head of 11, wherein:

the plurality of thin laminae comprise at least one layer of a non-polymeric material.

* * * * *